US006495313B2

(12) United States Patent
Yoshioka et al.

(10) Patent No.: US 6,495,313 B2
(45) Date of Patent: Dec. 17, 2002

(54) SILVER HALIDE COLOR PHOTOGRAPHIC LIGHT-SENSITIVE MATERIAL

(75) Inventors: Yasuhiro Yoshioka, Minami-Ashigara (JP); Shin Soejima, Minami-Ashigara (JP); Osamu Takahashi, Minami-Ashigara (JP); Naoki Saito, Minami-Ashigara (JP); Hisashi Mikoshiba, Minami-Ashigara (JP); Masakazu Morigaki, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/110,271

(22) Filed: Jul. 6, 1998

(65) Prior Publication Data

US 2001/0004512 A1 Jun. 21, 2001

(30) Foreign Application Priority Data

Jul. 9, 1997 (JP) ..... 9-197992

(51) Int. Cl.[7] ..... G03C 7/30

(52) U.S. Cl. ..... 430/551; 430/448; 430/546; 430/558

(58) Field of Search ..... 430/546, 551, 430/558, 448

(56) References Cited

U.S. PATENT DOCUMENTS

| | | | | |
|---|---|---|---|---|
| 5,330,888 A | | 7/1994 | Morigaki et al. | |
| 5,573,898 A | * | 11/1996 | Sakai | 430/503 |
| 5,660,975 A | * | 8/1997 | Ito et al. | 430/544 |
| 5,866,313 A | * | 2/1999 | Hirano | 430/551 |
| 5,871,880 A | * | 2/1999 | Makuta et al. | 430/218 |
| 6,005,111 A | * | 12/1999 | Taniguchi et al. | 430/448 |

FOREIGN PATENT DOCUMENTS

| | | | |
|---|---|---|---|
| EP | 0545300 A1 | | 6/1993 |
| EP | 0617322 A1 | | 9/1994 |
| JP | 9-288336 | * | 11/1997 |

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide color photographic light-sensitive material comprising a support having provided thereon: at least one yellow-color-forming light-sensitive silver halide emulsion layer; at least one magenta-color-forming light-sensitive silver halide emulsion layer; at least one cyan-color-forming light-sensitive silver halide emulsion layer; and at least one light-insensitive non-color-forming hydrophilic colloid layer, wherein at least one layer of said at least one cyan-color-forming light-sensitive silver halide emulsion layer contains at least one cyan-dye-forming coupler having a pKa of not more than 8.7, and wherein said at least one light-insensitive non-color-forming hydrophilic colloid layer contains at least one compound represented by the following formula (I):

(I)

wherein $R_1$, $R_2$, $R_3$ and $R_4$, which may be the same or different, each represents a hydrogen atom, an alkyl group or an aryl group; and $R_5$ represents an aryl group; provided that the total number of carbon atoms included in $R_1$, $R_2$, $R_3$, $R_4$ and $R_5$ is not less than 14.

24 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material. More particularly, the present invention relates to a silver halide color photographic light-sensitive material which is excellent in color forming property and rapid processing suitability and which provides color images having improved color reproducibility and image stability without severe degradation of images even when it is subjected to processing under such a condition that control of processing solutions is not necessarily satisfactory and a replenishment amount, pH, temperature or the like deviates from the proper range.

BACKGROUND OF THE INVENTION

It is well known that in a silver halide color photographic light-sensitive material an aromatic primary amine color developing agent oxidized with an exposed silver halide reacts with a coupler to form a dye such as an indophenol, an indoaniline, an indamine, an azomethine, a phenoxazine, a phenazine or a like dye, whereby a color image is formed. In this photographic system, a subtractive color process is ordinarily employed for color reproduction and color images are formed by yellow, magenta and cyan dyes.

Among them, in order to form cyan dye images, phenolic or naphtholic couplers are generally employed. However, these couplers have a problem in that color reproducibility is deteriorated since dyes formed therefrom have undesirable absorption in blue and green regions. Accordingly, it has been eagerly desired to solve such a problem.

In order to solve this problem, heterocyclic compounds have been proposed as described in U.S. Pat. Nos. 4,728,598 and 4,873,183 and EP-A-0249453. These couplers have, however, other fatal defects in that they have a low coupling activity and in that fastness of dyes formed therefrom are poor.

Pyrrolotriazole couplers have been proposed in U.S. Pat. No. 5,256,526 and European Patent 0545300 as couplers for solving the above-described problems. These couplers are excellent in hue and coupling activity. However, fastness of dye images formed therefrom is not always satisfactory and in particular, light fastness of color images in low density areas is poor in comparison with dye images formed from conventional couplers. Accordingly, improvement in the fastness of dye images has been expected. Further, it has been desired that whiteness in white background areas of the images be well maintained for a long period of time.

On the other hand, in the field of photographic processing, rapidity of processing and decrease in an amount of replenishment have been promoted in response to market needs. In order to conduct the rapid processing, it is important that a coupler used is highly active. For the purpose of developing such a highly active coupler, various investigations have been made, for example, to employ a straight chain alkyl group as a ballast group in the coupler, to introduce a dissociate group into the coupler or to lower a pKa of the coupler. However, these means for increasing the activity of coupler also cause undesirable increase in fog and stain. It is particularly important problem to be consistent the rise of activity with the restraint of fog and stain formed in the processing of low replenishment which imposes a large load on a photographic light-sensitive material.

Moreover, the control of processing solutions is not necessarily satisfactory in labs and so that the processing is carried out under circumstances wherein a replenishment amount, pH or the like deviates from the proper range. In such a case, color mixing due to processing gives rise to trouble as well as the increase in fog and stain described above. Thus, the finishing quality of color photographs is adversely affected by these problems in practice.

SUMMARY OF THE INVENTION

Therefore, an object of the present invention is to provide a silver halide color photographic light-sensitive material which contains a highly active coupler having improved color forming property and rapid processing suitability, and which provides color images with excellent color reproducibility and image stability and with less occurrence of fog and stain even when it is processed under such a condition that an amount of replenishment is decreased and control of the processing is not necessarily adequate.

Other objects and effects of the present invention will become apparent from the following description.

The above-described objects of the present invention have been achieved by providing a silver halide color photographic light-sensitive material comprising a support having provided thereon:

at least one yellow-color-forming light-sensitive silver halide emulsion layer;

at least one magenta-color-forming light-sensitive silver halide emulsion layer;

at least one cyan-color-forming light-sensitive silver halide emulsion layer; and at least one light-insensitive non-color-forming hydrophilic colloid layer, wherein at least one layer of said at least one cyan-color-forming light-sensitive silver halide emulsion layer contains at least one cyan-dye-forming coupler having a pKa of not more than 8.7, and wherein said at least one light-insensitive non-color-forming hydrophilic colloid layer contains at least one compound represented by the following formula (I):

(I)

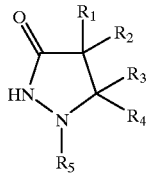

wherein $R_1$, $R_2$, $R_3$ and $R_4$, which may be the same or different, each represents a hydrogen atom, an alkyl group or an aryl group; and $R_5$ represents an aryl group; provided that the total number of carbon atoms included in $R_1$, $R_2$, $R_3$, $R_4$ and $R_5$ is not less than 14.

In a preferred embodiment, the compound represented by formula (I) is:

a compound represented by the following formula (II):

(II)

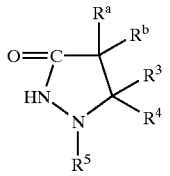

wherein $R^a$ and $R^b$ each represents an aryl group or an alkyl group; $R^3$ and $R^4$ each represents a hydrogen atom, an alkyl group or an aryl group; and $R^5$ represents an aryl group; or a compound represented by the following formula (III):

(III)

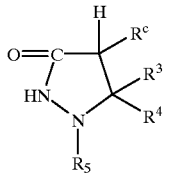

wherein $R^c$ represents an alkyl group or an aryl group; $R^3$ and $R^4$ each represents a hydrogen atom, an alkyl group or an aryl group; and $R^5$ represents an aryl group.

In another preferred embodiment, the cyan-dye-forming coupler is represented by the following general formula (IV):

(IV)

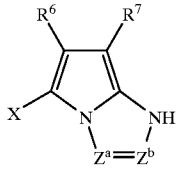

wherein $Z^a$ and $Z^b$ each represents —C($R^8$)═ or —N═, provided that one of $Z^a$ and $Z^b$ is —N═ and the other is —C($R^8$)═; $R^6$ and $R^7$ each represents an electron attractive group having a Hammett's substituent constant $\sigma_p$ value of 0.20 or more and the sum of the $\sigma_p$ values of $R^6$ and $R^7$ is 0.65 or more; $R^8$ represents a hydrogen atom or a substituent; X represents a hydrogen atom or a group capable of being released upon a coupling reaction with an oxidation product of an aromatic primary amine color developing agent; and group represented by $R^6$, $R^7$, $R^8$ or X may be a divalent group to form a dimer or more, or combine with a polymer chain to form a homopolymer or a copolymer.

In the silver halide color photographic light-sensitive material according to the present invention, the cyan-color-forming light-sensitive silver halide emulsion layer preferably further contains at least one compound represented by formula (I).

Furthermore, the compound represented by formula (I) contained in the cyan-color-forming light-sensitive silver halide emulsion layer is more preferably a compound represented by formula (III).

Moreover, it is preferred in the present invention that either or both of the yellow-color-forming light-sensitive silver halide emulsion layer and the magenta-color-forming light-sensitive silver halide emulsion layer further contains at least one compound represented by formula (I).

In the present invention, the groups represented by $R_1$, $R_2$, $R_3$, $R_4$ and $R_5$ in formula (I) and the groups represented by $R^a$, $R^b$, $R^c$, $R^3$, $R^4$ and $R^5$ in formulae (II) and (III) mean and include not only unsubstituted groups but also substituted groups, respectively.

DETAILED DESCRIPTION OF THE INVENTION

Now, the Hammett's substituent constant $\sigma_p$ value used in the present specification will be explained below.

The Hammett's rule is an empirical rule which was proposed by L. P. Hammett in 1935 in order to quantitatively examine an effect of a substituent on a reaction or equilibrium of a benzene derivative and its propriety is widely admitted at present.

The substituent constants obtained by the Hammett's rule include $\sigma_p$ values and $\sigma_m$ values and these values are described in detail in many references, for example, J. A. Dean (Ed.) *Lange's Handbook of Chemistry,* 12th Edition (McGraw Hill, 1979) and *Kagaku no Ryoiki Zokan*, Vol. 122, pages 96 to 103 (Nankodo, 1979).

In the present invention, each substituent on the cyan-dye-forming coupler is defined by the Hammett's substituent constant $\sigma_p$ value. However, it should be noted that the substituents are not limited to those having their known values described in references, and include substituents having the Hammett's substituent constant $\sigma_p$ value within the above described range when determined based on the Hammett's rule, even if the values of the substituents are not described in references. Although the compound represented by formula (IV) is not a benzene derivative, the $\sigma_p$ value is utilized as a measure for indicating electron effect of a substituent in spite of the substitution position thereof. In the present invention, the $\sigma_p$ value is employed in such a sense hereinafter.

The term "oleophilic" used in the present invention means that the solubility of a compound in question in water is 10% by weight or less at room temperature.

In the specification, an aliphatic group may be straight chain, branched chain or cyclic, and may be saturated or unsaturated. Examples of the aliphative group includes an alkyl group, an alkenyl group, an alkynyl group, a cycloalkyl group and a cycloalkenyl group. The aliphatic group may have one ore more substituents. An aromatic group represents an aryl group and may have one or more substituents. A heterocyclic group is a cyclic group containing one ore more hetero atoms in its ring and includes an aromatic heterocyclic group. The heterocyclic group may have one ore more substituents. A substituent including the substituent on the aliphatic, aromatic or heterocyclic group may be any group capable of substituting as far as otherwise indicated, and includes, for example, an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxy group, a cyano group, a nitro group, a hydroxyamino group and a halogen atom.

Now, the compound represented by formula (I) for use in the present invention is described in more detail below.

In formula (I), when $R_1$ or $R_2$ represents the alkyl group, the total number of carbon atoms in each group (including the substituent(s) thereof) is preferably from 1 to 30, more preferably from 1 to 20. When $R_1$ or $R_2$ represents the aryl group, the total number of carbon atoms in each group (including the substituent(s) thereof) is preferably from 6 to 30. When $R_3$ or $R_4$ represents the alkyl group, the total number of carbon atoms in each group (including the substituent(s) thereof) is preferably from 1 to 24, more preferably from 1 to 18. When $R_3$ or $R_4$ represents the aryl group, the total number of carbon atoms in each group (including the substituent(s) thereof) is preferably from 6 to 24.

The substituent for the alkyl group represented by $R_1$, $R_2$, $R_3$ or $R_4$ is not particularly limited. Preferred examples of the substituent includes a halogen atom, an alkoxy group, an aryl group, an aryloxy group, an acyl group, an acyloxy group, an alkoxycarbonyl group, a sulfonyl group, a phosphoryl group, an alkylthio group, an arylthio group, an acylamino group, a carbamoyl group, a sulfamoyl group, a sulfonamido group, a carbamoylamino group and an alkoxycarbonylamino group. A halogen atom, an alkoxy group, an acyloxy group, an alkoxycarbonyl group, an aryloxy group and an acylamino group are more preferred. Also, the substituent for the alkyl group may contain one or more unsaturated bonds.

The substituent for the aryl group represented by $R_1$, $R_2$, $R_3$ or $R_4$ is not particularly limited and examples thereof include an alkyl group and the above enumerated substituents for the alkyl group. Of these, an alkyl group, a halogen atom, an alkoxy group, an acyloxy group and an acylamino group are preferred.

The number of carbon atoms in $R_5$ is preferably from 6 to 30, more preferably from 6 to 24. The substituent for the aryl group represented by $R_5$ and preferred examples thereof are the same as those described above for the aryl group represented by $R_1$, $R_2$, $R_3$ or $R_4$.

The compound represented by formula (I) is employed by fixing in oil droplets and dispersing in a hydrophilic colloid. Therefore, the compound must be olephilic. It is preferred to introduce an olephilic group (oil-solubilizing group) into at least one of $R_1$, $R_2$, $R_3$, $R_4$ and $R_5$. The total number of carbon atoms included in $R_1$, $R_2$, $R_3$, $R_4$ and $R_5$ is at least 14, preferably from 16 to 40, and more preferably from 18 to 36.

The oil-solubilizing group is preferably introduced into $R_1$ or $R_5$.

When the oil-solubilizing group is introduced into $R_1$, preferred examples of the oil-solubilizing group include a straight chain or branched chain unsubstituted alkyl group having form 12 to 24 carbon atoms and an alkyl group having from 12 to 36 carbon atoms substituted with an alkoxy group, an aryloxy group, an acyl group or an alkoxycarbonyl group. An unsubstituted alkyl group having from 14 to 20 carbon atoms is particularly preferred. In this case, the aryl group represented by $R_5$ may be substituted, but is preferably unsubstituted.

When the oil-solubilizing group is introduced into the aryl group represented by $R_5$, preferred examples of the oil-solubilizing group include an alkyl group, an alkoxy group, an acyloxy group and an acylamino group each having from 12 to 30 carbon atoms. An alkoxy group having from 12 to 24 carbon atoms is particularly preferred.

$R_3$ and $R_4$ preferably represent hydrogen atoms, respectively.

Of the compounds represented by formula (I), compounds represented by formula (II) or (III) are preferred in view of preservability.

Now, the compound represented by formula (II) for use in the present invention is described in more detail below.

In formula (II), $R^a$ and $R^b$ each individually represents a substituted or unsubstituted aryl group or a substituted or unsubstituted alkyl group (preferably having from 1 to 30 carbon atoms in total including the substituent(s)).

When $R^a$ or $R^b$ represents the substituted aryl group, the substituent for the aryl group is the same as that defined for $R_1$ in formula (I) and specific examples thereof also include those described for $R_1$.

Preferred examples of the substituent include an alkyl group, an alkoxy group, an acylamino group, a halogen atom, an aminocarbonylamino group and an alkoxycarbonylamino group. An alkyl group having from 1 to 10 carbon atoms, a halogen atom (e.g., chlorine or bromine) or an alkoxy group having from 1 to 10 carbon atoms is more preferred for the substituent.

When $R^a$ or $R^b$ represents the alkyl group, the total number of carbon atoms including the substituent(s) is from 1 to 30. An unsubstituted alkyl group may be a straight chain or branched chain alkyl group. The straight chain alkyl group preferably has from 1 to 26 carbon atoms (e.g., ethyl, n-propyl, n-butyl, n-hexyl, n-octyl, n-decyl, n-octadecyl, or n-eicosyl), and the branched chain alkyl group preferably has from 3 to 26 carbon atoms (e.g., isopropyl, tert-butyl, or 2-ethylhexyl).

When $R^a$ or $R^b$ represents the substituted alkyl group, the substituent for the alkyl group is the same as that defined for $R_1$ in formula (I) and the total number of carbon atoms including the substituent(s) is preferably from 1 to 20. Specific examples of the substituent for the alkyl group also include those described for $R_1$. Specific examples of the substituted alkyl group include ethoxymethyl, acetoxymethyl, stearoyloxymethyl, p-phenoxymethyl, 1-nitrophenoxymethyl, and 1-chlorooctyl.

In formula (II), $R^3$ and $R^4$ each represents a hydrogen atom, a substituted or unsubstituted alkyl group or a substituted or unsubstituted aryl group.

When $R^3$ or $R^4$ represents the substituted alkyl group or the substituted aryl group, the substituents for the alkyl group and aryl group are the same as those defined for $R_1$ in formula (I), respectively, and specific examples thereof also include those described for $R_1$, respectively.

The alkyl group represented by $R^3$ or $R^4$ preferably has from 1 to 20 carbon atoms. An unsubstituted alkyl group is preferred than a substituted alkyl group for $R^3$ or $R^4$.

The aryl group represented by $R^3$ or $R^4$ preferably has from 6 to 20 carbon atoms.

It is preferred that at least one of $R^3$ and $R^4$ represents a hydrogen atom. Most preferably, both $R^3$ and $R^4$ are hydrogen atoms.

In formula (II), $R^5$ represents a substituted or unsubstituted aryl group. When $R^5$ represents the substituted aryl group, the substituent for the aryl group is the same as that defined for $R_1$ in formula (I) and specific examples thereof also include those described for $R_1$.

Preferred examples of the substituent include an alkyl group having from 1 to 20 carbon atoms (e.g., methyl, ethyl, isopropyl, tert-butyl, or n-octyl), an alkoxy group having from 1 to 20 carbon atoms (e.g., methoxy, ethoxy, isopropoxy, tert-butoxy, n-octyloxy, n-tetradecyloxy, n-hexadecyloxy, or n-octadecyloxy), an acylamino group having from 1 to 20 carbon atoms (e.g., acetylamino, propiponylamino, or stearoylamino), an alkoxycarbonylamino group having from 2 to 20 carbon atoms (e.g., methoxycarbonylamino, ethoxycarbonylamino, or octyloxycarbonylamino), an aminocarbonylamino group having from 1 to 20 carbon atoms (e.g., dimethylaminocarbonylamino, or dioctylaminocarbonylamino), an alkylsulfonylamino group having from 1 to 20 carbon atoms (e.g., methanesulfonylamino, ethanesulfonylamino, butanesulfonylamino, or octanesulfonylamino), and an arylsulfonylamino group having from 6 to 20 carbon atoms (e.g., benzenesulfonylamino, toluenesulfonylamino, or dodecylbenzenesulfonylamino).

The compound represented by formula (II) is preferably has a so-called ballast group in at least one of $R^a$, $R^b$, $R^3$, $R^4$ and $R^5$ in view of diffusion resistivity. The molecular weight of the compound is preferably 200 or more, more preferably 250 or more, yet more preferably 300 or more, and most preferably 350 or more.

Now, the compound represented by formula (III) for use in the present invention is described in more detail below.

In formula (III), $R^3$, $R^4$ and $R^5$ each has the same meaning as defined in formula (II) above. Specific examples and preferred examples are also same as those described in formula (II). $R^c$ represents a substituted or unsubstituted alkyl group or a substituted or unsubstituted aryl group.

When $R^c$ represents the substituted alkyl group or the substituted aryl group, the substituents for the alkyl group and aryl group are the same as those defined for $R_1$ in formula (I), respectively, and specific examples thereof also include those described for $R_1$, respectively.

$R^c$ preferably represents an alkyl group having from 1 to 20 carbon atoms (e.g., methyl, ethyl, isopropyl, tert-butyl, n-octyl, n-dodecyl, n-hexadecyl, n-octadecyl, isooctadecyl, 2-ethylhexyl, 2-methoxyethyl, or 2-chloroethyl), or an aryl group having from 6 to 20 carbon atoms (e.g., phenyl, naphthyl, p-chlorophenyl, m-methoxyphenyl or o-methylphenyl).

The compound represented by formula (III) preferably has a so-called ballast group in at least one of $R^c$, $R^3$, $R^4$ and $R^5$ in view of diffusion resistivity. The molecular weight of the compound is preferably 200 or more, more preferably 250 or more, further more preferably 300 or more, and most preferably 350 or more. In particular, a preferred case is where $R^c$ is a ballast group, more preferably an unsubstituted alkyl group, which preferably has from 12 to 24 carbon atoms, more preferably from 12 to 20 carbon atoms.

Of the phenidone compounds represented by formula (II) or (III) according to the present invention, those represented by formula (II) are more preferred for adding to a light-insensitive layer, and those represented by formula (III) are more preferred for adding to a light-sensitive layer. Taking into account the production cost of the photographic material and the performance thereof, it is preferred that each of the light-insensitive layer and the light-sensitive layer contains the same compound represented by formula (III).

Of the compounds represented by formula (III), those wherein $R^c$ is an alkyl group, both $R^3$ and $R^4$ are hydrogen atoms, and $R^5$ is a substituted or unsubstituted aryl group are preferred.

Among them, those wherein $R^5$ is an unsubstituted aryl group, or an aryl group substituted with an alkoxy group, an acylamino group, an alkylsulfonylamino group or an arylsulfonylamino group are ore preferred, and those wherein $R^5$ is an unsubstituted aryl group or an aryl group substituted with an alkoxy group are yet more preferred.

An unsubstituted alkyl group is more preferred than a substituted alkyl group for $R^c$.

Of the compounds represented by formula (III), those wherein $R^c$ is an unsubstituted alkyl group, both $R^3$ and $R^4$ are hydrogen atoms, and $R^5$ is an unsubstituted aryl group are most preferred.

Specific examples of the compound represented by formula (II) or (III) which can be used in the present invention are set forth below, but the present invention should not be construed as being limited thereto.

1.

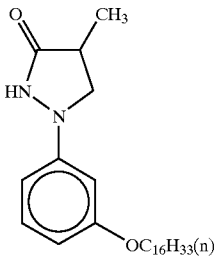

2.

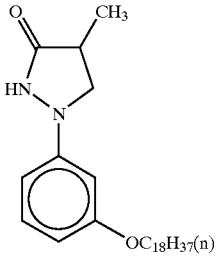

3.

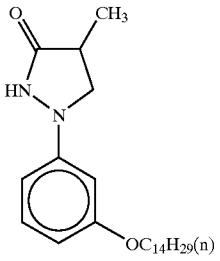

4.

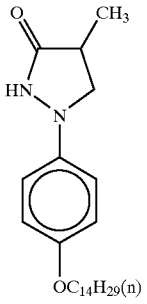

-continued
5.
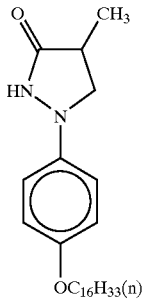
6.
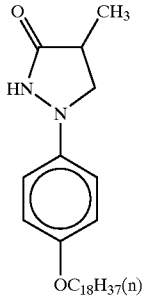
7.
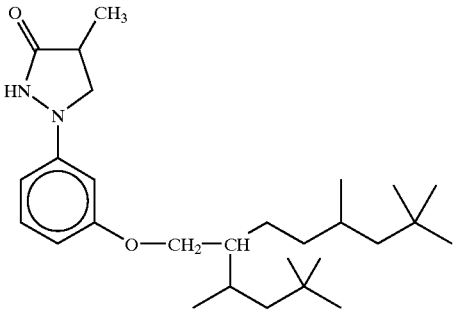
8.
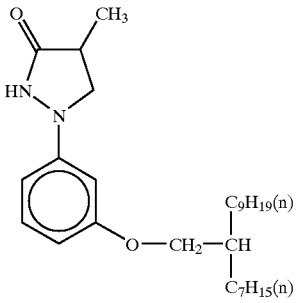
9.
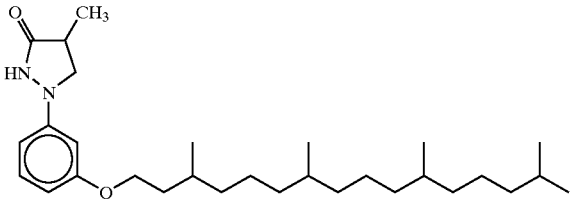
-continued
10.
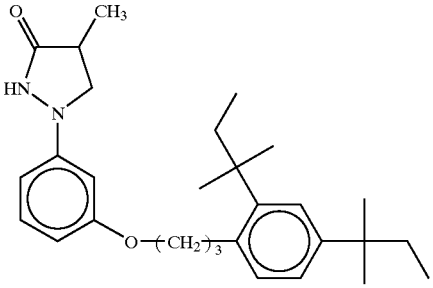
11.
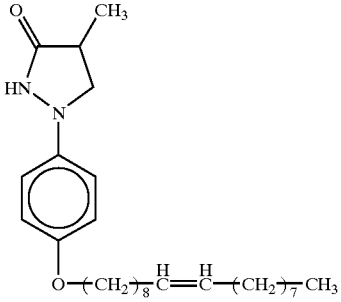
12.
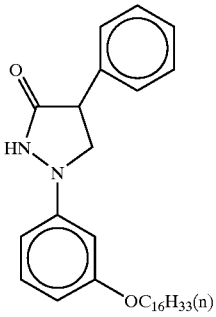
13.
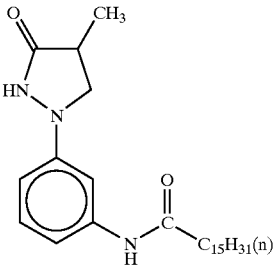
14.
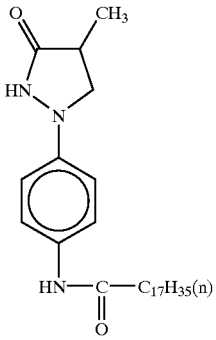

-continued
15.
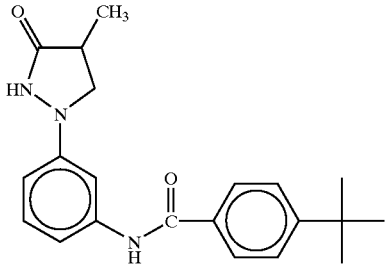
16.
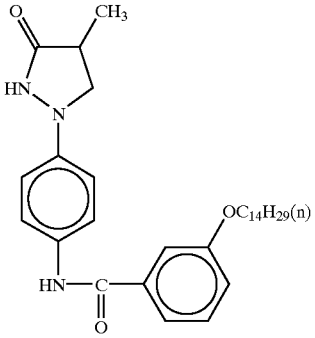
17.
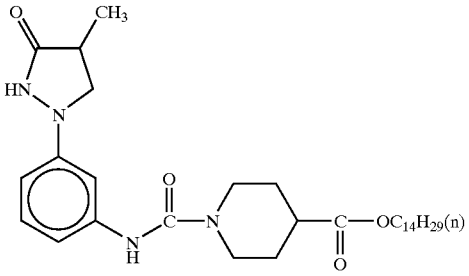
18.
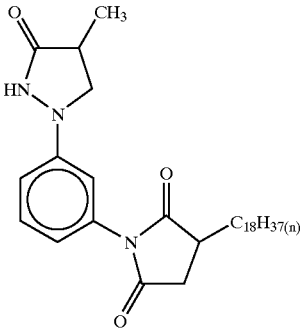
19.
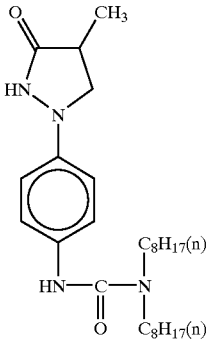
-continued
20.
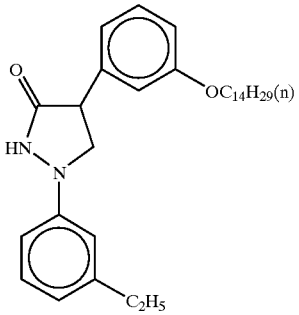
31.
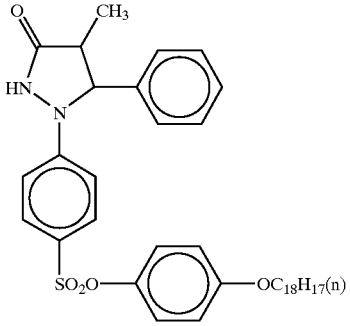
32.
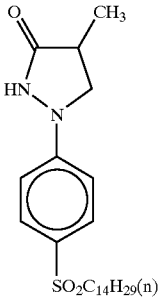
33.
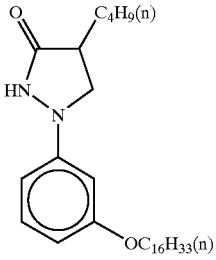
34.
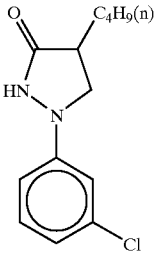

-continued
35.
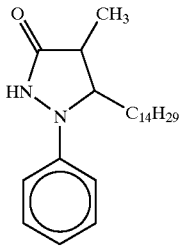
36.
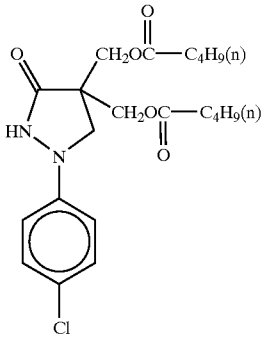
37.
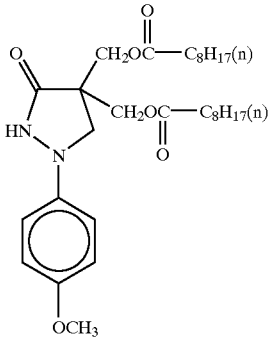
38.
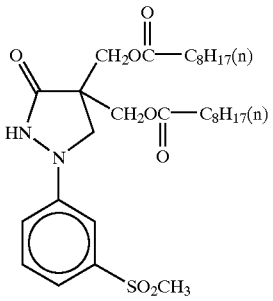
39.
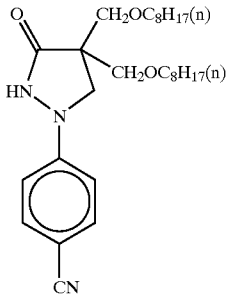
-continued
40.
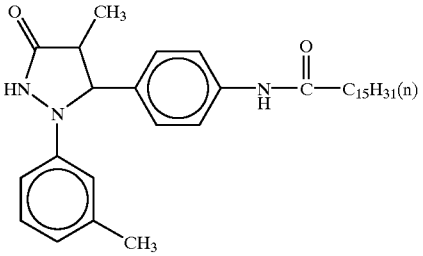
41.
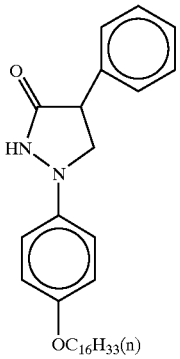
43.
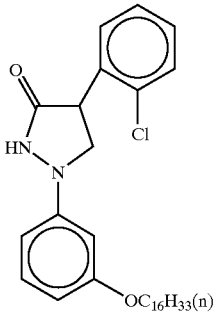
44.
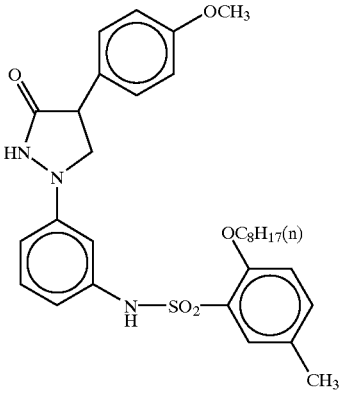
45.
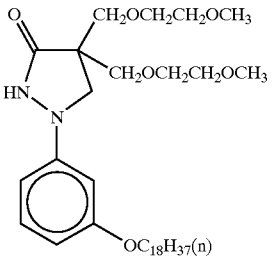

-continued
46.
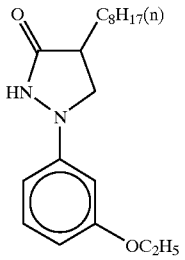
47.
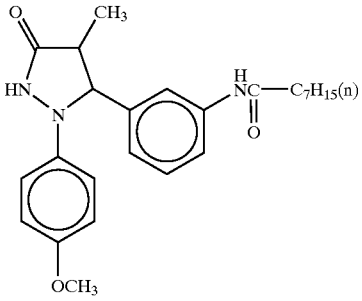
47.
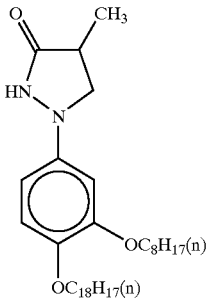
48.
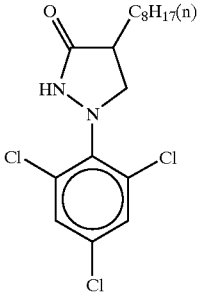
49.
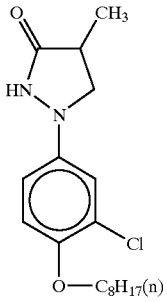
-continued
50.
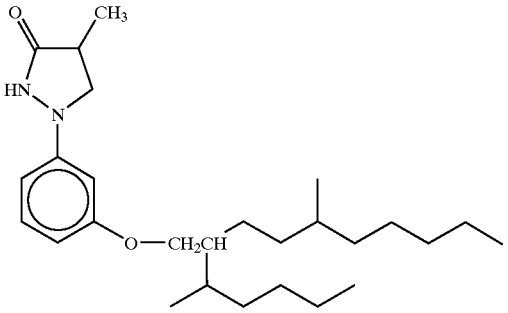
51.
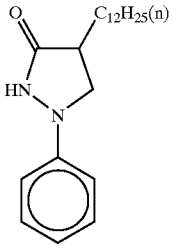
52.
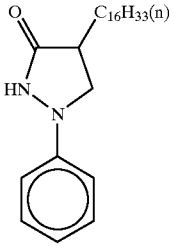
53.
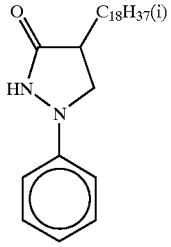
54.
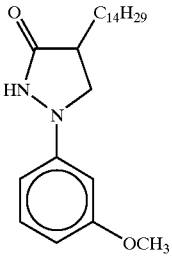
55.
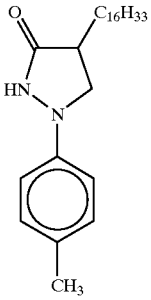

-continued
56.
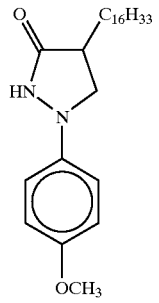
57.
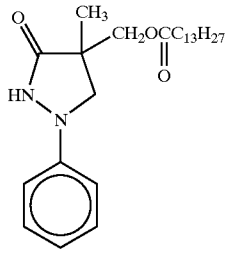
58.
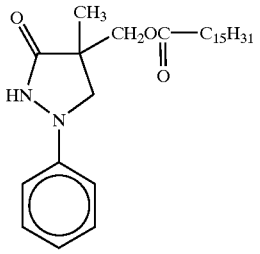
59.
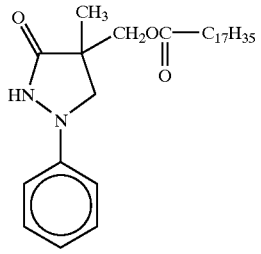
60.
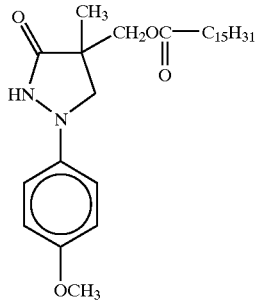
-continued
61.
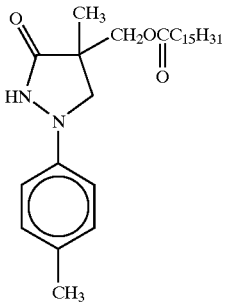
62.
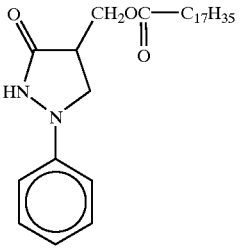
63.
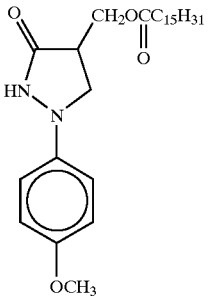
64.
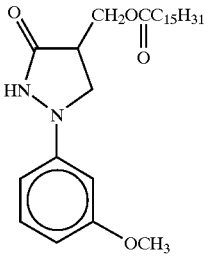
65.
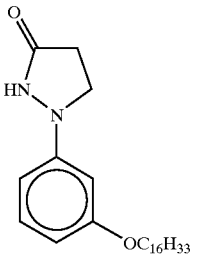

-continued

66.

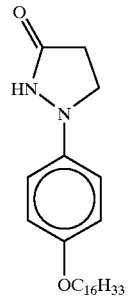

67.

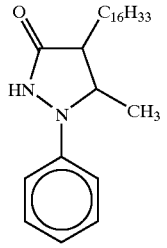

68.

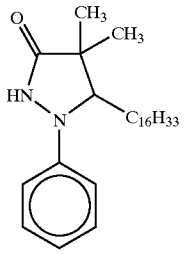

69.

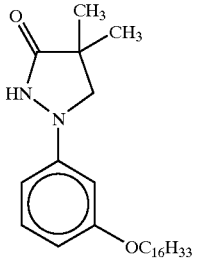

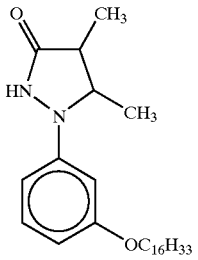

71.

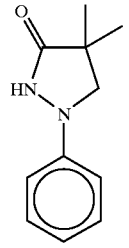

-continued

72.

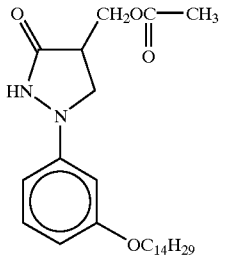

Synthesis methods of the compounds represented by formulae (II) and (III) are described below.

The compound represented by formula (II) can be synthesized by a reaction of a compound represented by formula (II)-A with a hydrazine according to the method shown below.

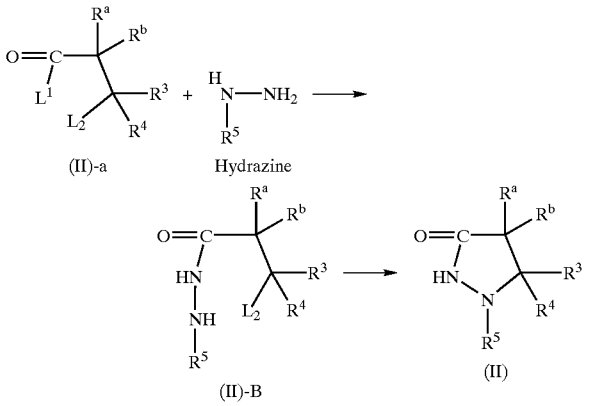

wherein $L^1$ and $L^2$ each represents a group capable of being released upon a nucleophilic reaction; and $R^a$, $R^b$, $R^3$ and $R^4$ have the same meanings as $R^a$, $R^b$, $R^3$ and $R^4$ defined in formula (II), respectively.

70. The group represented by $L^1$ is preferably a halogen atom or an oxygen atom activated with a condensing agent. The group represented by $L^2$ is preferably a hydroxy group or a halogen atom.

The reaction can be ordinarily performed at temperature of from −20° C. to 180° C., preferably from 0° C. to 120° C., and more preferably from 30° C. to 90° C.

The reaction time is ordinarily from 5 minutes to 24 hours, and more preferably from one hour to 6 hours.

The reaction from Compound represented by formula (II)-B to Compound of formula (II) is preferably conducted under an acidic condition when $L^2$ is a hydroxy group. On the other hand, when $L^2$ is a halogen atom, the reaction can be carried out under any of acid, neutral or alkaline condition.

The compound represented by formula (III) can be synthesized by a ring closing reaction of a compound represented by formula (III)-A with a hydrazine according to the method shown below.

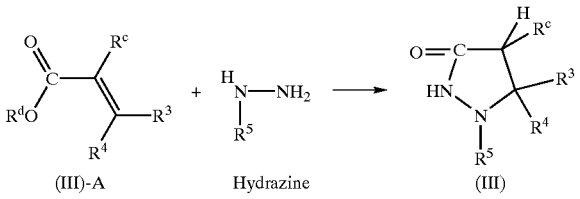

wherein $R^d$ represents an alkyl group or an aryl group, and $R^c$, $R^3$, $R^4$ and $R^5$ have the same meanings as $R^c$, $R^3$, $R^4$ and $R^5$ defined in formula (III), respectively.

The reaction is preferably conducted using at least one equivalent of a base in an appropriate solvent. When a hydrazine salt is employed, it is preferred to use two or more equivalents of base in order to liberate a hydrazine. As the base, an alkoxide is preferably used. Specific examples thereof include potassium tert-butoxide and sodium methoxide. Suitable examples of the solvent include n-butanol, tert-butanol, dimethylsulfoxide and dimethylacetamide.

The reaction can be ordinarily performed at temperature of from −20° C. to 180° C., preferably from 0° C. to 120° C., and more preferably from 30° C. to 90° C.

The reaction time is ordinarily from 5 minutes to 24 hours, preferably from 30 minutes to 6 hours, and more preferably from one hour to 3 hours.

A ratio of the hydrazine and the compound of formula (III)-A used preferably from 2:1 to 1:2 by mole, and more preferably from 1.2:1 to 1:1.2 by mole.

Synthesis example of the compound is specifically set forth below.

Synthesis of Compound 52

Compound 52 was synthesized along the route shown below.

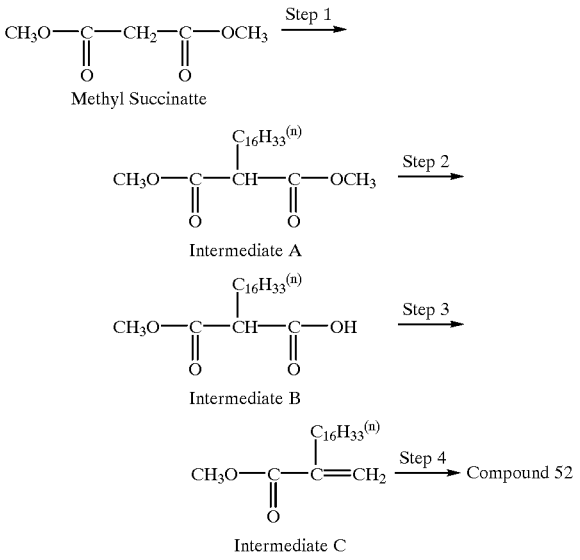

Step 1

A mixture of 256 g (1.94 mol) of methyl succinate and 800 ml of methanol was stirred at room temperature and was added dropwise thereto 375 g (1.94 mol) of sodium methylate (28% by weight). Then, 592 g (1.94 mol) of 1-bromohexadecane was added dropwise thereto. After refluxing for 3 hours, the methanol was distilled off, and the residue was poured into 1 N hydrochloric acid. The mixture was extracted with hexane, and the extract was washed with an aqueous sodium chloride solution and dried. The solvent was distilled off to obtain 511 g (1.43 mol, yield: 73.7%) of Intermediate A.

Step 2

To a mixture of 511 g (1.43 mol) of Intermediate A and 800 ml of methanol was added dropwise a solution containing 94.6 g (1.43 mol) of potassium hydroxide (purity: 85% by weight) dissolved in 800 ml of methanol at 35° C. with stirring. After reacting at 40° C. for 2 hours, a solution containing 130 ml of concentrated hydrochloric acid dissolved in 500 ml of water was added dropwise. The crystals thus-deposited were collected by filtration, washed with water and n-hexane to obtain Intermediate B which was used in the next step without drying.

Step 3

To a mixture of the whole amount (1.43 mol) of Intermediate B and 1.0 liter of methanol was added dropwise 115 g (1.57 mol) of diethylamine at 20° C. with stirring. Then, 135 g (1.57 mol) of a 35% aqueous formaldehyde solution was added dropwise thereto, followed by reacting at 20° C. for 24 hours. The crystals thus-deposited were collected by filtration, washed with water and methanol and dried to obtain 396 g (1.28 mol, yield: 89.5%) of Intermediate C.

Step 4

A mixture of 1.45 g (1.34 mol) of phenylhydrazine and 1.5 liters of toluene was stirred at 140° C. and the solvent was distilled off using a Dean-Stark dehydrator until the inner temperature became 100° C. Then, 272 g (1.41 mol) of sodium methylate (28%) by weight) was added dropwise thereto and methanol was distilled off. A solution containing 396 g (1.28 mol) of Intermediate C in 400 ml of toluene was added dropwise thereto.

After refluxing for 30 minutes, the reaction mixture was cooled with ice, and were added 150 ml of concentrated hydrochloric acid and then 200 ml of ethyl acetate thereto. The insoluble substance was removed by filtration and the filtrate was cooled. The crystals thus-deposited were collected by filtration, washed with water and n-hexane and dried to obtain 393 g (1.02 mol, yield: 79.7%) of Compound 51.

Other compounds of formula (I) are synthesized in an analogous manner with reference to the synthesis method described above.

The effect of the present invention obtained by using the compound represented by formula (I) is that the occurrence of cyan fog, cyan stain and color mixing due to processing which is markedly observed when a highly active cyan coupler having a pKa of not more than 8.7 is employed is restrained without unfavorable influence on other photographic characteristics. The effect is commonly recognized when the compound represented by formula (I) is employed together with a cyan coupler having a pKa of not more than 8.7.

Therefore, the cyan-dye-forming coupler for use in the present invention is not particularly restricted on its structure as far as it has a pKa of not more than 8.7. The effect of the present invention becomes larger in case of using a coupler having a pKa of not more than 8.0, and yet larger in case of using a coupler having a pKa of not more than 7.5.

The pKa of the coupler can be easily determined by obtaining a pH of a point where neutralization is performed just half on a pH titration curve measured in a solvent mixture of tetrahydrofuran and water in a ratio of 6/4 by volume.

With respect to the cyan coupler represented by formula (IV) described in detail hereinafter, the occurrence of cyan fog, cyan stain and color mixing due to processing becomes severer problem due to a large molecular absorption coefficient of a dye formed therefrom and so that the use of the compound represented by formula (I) according to the present invention together therewith is very important.

Besides the coupler represented by formula (IV), a cyan coupler having a molecular absorption coefficient of not less than 30,000 is preferably used in combination with the compound represented by formula (I). The combination with a cyan coupler having a molecular absorption coefficient of not less than 40,000 is more preferred. Particularly, the combination with a cyan coupler having a molecular absorption coefficient of not less than 50,000 including the coupler represented by formula (IV) is preferred.

Now, the cyan-dye-forming coupler represented by formula (IV) for use in the present invention is described in more detail below.

In formula (IV), $Z^a$ and $Z^b$ each represents —C($R^8$)═ or —N═, provided that one of $Z^a$ and $Z^b$ is —N═ and the other is —C($R^8$)═.

$R^8$ represents a hydrogen atom or a substituent. The substituent includes, for example, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, and an acyl group. These groups may be further substituted with substituent(s) same as those described for $R^8$.

More specifically, $R^8$ represents a hydrogen atom, a halogen atom (e.g., chlorine, or bromine), an alkyl group (for example, a straight chain or branched chain alkyl group having from 1 to 32 carbon atoms, an aralkyl group, an alkenyl group, an alkynyl group, a cycloalkyl group, or a cycloalkenyl group including, e.g., methyl, ethyl, propyl, isopropyl, tert-butyl, tridecyl, 2-methanesulfonylethyl, 3-(3-pentadecylphenoxy)propyl, 3-[4-{2-[4-(4-hydroxyphenylsulfonyl)phenoxy]dodecanamido}phenyl]propyl, 2-ethoxytridecyl, trifluoromethyl, cyclopentyl, or 3-(2,4-di-tert-amylphenoxy) propyl), an aryl group (e.g., phenyl, 4-tert-butylphenyl, 2,4-di-tert-amylphenyl, or 4-tetradecanamidophenyl), a heterocyclic group (e.g., imidazolyl, pyrazolyl, triazolyl, 2-furyl, 2-thienyl, 2-pyrimidinyl, or 2-benzothiazolyl), a cyano group, a hydroxy group, a nitro group, a carboxy group, an amino group, an alkoxy group (e.g., methoxy, ethoxy, 2-methoxyethoxy, 2-dodecyloxyethoxy, or 2-methanesulfonylethoxy), an aryloxy group (for example, phenoxy, 2-methylphenoxy, 4-tert-butylphenoxy, 3-nitrophenoxy, 3-tert-butyloxycarbamoylphenoxy, or 3-methoxycarbamoylphenoxy), an acylamino group (e.g., acetamido, benzamido, tetradecanamido, 2-(2,4-di-tert-amylphenoxy)butanamido, 4-(3-tert-butyl-4-hydroxyphenoxy)butanamido, or 2-[4-(4-hydroxyphenylsulfonyl)phenoxy]decanamido), an alkylamino group (e.g., methylamino, butylamino, dodecylamino, diethylamino, or methylbutylamino), an anilino group (e.g., phenylamino, 2-chloroanilino, 2-chloro-5-tetradecanaminoanilino, 2-chloro-5-dodecyloxycarbonylanilino, N-acetylanilino, or 2-chloro-5-[2-(3-tert-butyl-4-hydroxyphenoxy)dodecanamido]anilino), a ureido group (e.g., phenylureido, methylureido, or N,N-dibutylureido), a sulfamoylamino group (e.g., N,N-dipropylsulfamoylamino, or N-methyl-N-decylsulfamoylamino), an alkylthio group (for example, methylthio, octylthio, tetradecylthio, 2-phenoxyethylthio, 3-phenoxypropylthio, or 3-(4-tert-butylphenoxy) propylthio), an arylthio group (e.g., phenylthio, 2-butoxy-5-tert-octylphenylthio, 3-pentadecylphenylthio, 2-carboxyphenylthio, or 4-tetradecanamidophenylthio), an alkoxycarbonylamino group (e.g., methoxycarbonylamino, or tetradecyloxycarbonylamino), a sulfonamido group (e.g., methanesulfonamido, hexadecanesulfonamido, benzenesulfonamido, p-toluene-sulfonamido, octadecanesulfonamido, or 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy) propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (e.g., methanesulfonyl, octanesulfonyl, benzenesulfonyl, or toluenesulfonyl), an alkoxycarbonyl group (e.g., methoxycarbonyl, butoxycarbonyl, dodecyloxycarbonyl, or octadecyloxycarbonyl), a heterocyclic oxy group (e.g., 1-phenyltetrazolyl-5-oxy, or 2-tetrahydropyranyloxy), an azo group (e.g., phenylazo, 4-methoxyphenylazo, 4-pivaloylaminophenylazo, or 2-hydroxy-4-propanoylphenylazo), an acyloxy group (e.g., acetoxy), a carbamoyloxy group (e.g., N-methylcarbamoyloxy, or N-phenylcarbamoyloxy), a silyloxy group (e.g., trimethylsilyloxy, or dibutylmethylsilyloxy), an aryloxycarbonylamino group (e.g., phenoxycarbonylamino), an imido group (e.g., N-succinimido, N-phthalimido, or 3-octadecenylsuccinimido), a heterocyclic thio group (e.g., 2-benzothiazolylthio, 2,4-di-phenoxy-1,3,5-triazolyl-6-thio, or 2-pyridylthio), a sulfinyl group (e.g., dodecanesulfinyl, 3-pentadecylphenylsufinyl, or 3-phenoxypropylsulfinyl), a phosphonyl group (e.g., phenoxyphosphonyl, octyloxyphosphonyl, or phenylphosphonyl), an aryloxycarbonyl group (e.g., phenoxycarbonyl), or an acyl group (e.g., acetyl, 3-phenylpropanoyl, benzoyl, or 4-dodecyloxybenzoyl).

$R^8$ preferably represents an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, or an acyl group.

More preferably, $R^8$ represents an alkyl group or an aryl group. $R^8$ yet more preferably represents an alkyl group or aryl group each having at least one substituent in view of association. Further preferably $R^8$ represents an alkyl group or aryl group each having at least one alkyl group, alkoxy group, sulfonyl group, sulfamoyl group, carbamoyl group, acylamido group, or sulfonamido group as a substituent. $R^8$ particularly preferably represents an alkyl group or aryl group each having at least one alkyl group, acylamido group or sulfonamido group as a substituent. Where $R^8$ is an aryl group, the substituent is more preferably present at least at an ortho position or a para position thereof. The alkyl group and the alkyl moiety in the group having an alkyl moiety used in formula (IV) each includes those enumerated for the alkyl group represented by $R^8$.

In the cyan-dye-forming coupler represented by formula (IV) according to the present invention, it is defined that $R^6$ and $R^7$ each represents an electron attractive group having a Hammett's substituent constant $\sigma_p$ value of 0.20 or more and the sum of the $\sigma_p$ values of $R^6$ and $R^7$ is 0.65 or more to form a cyan dye image upon color development.

The sum of the $\sigma_p$ values of $R^6$ and $R^7$ is preferably not less than 0.70, and the upper limit thereof is about 2.0.

$R^6$ and $R^7$ each represents an electron attractive group having a Hammett's substituent constant $\sigma_p$ value of 0.20 or more, preferably 0.30 or more. The upper limit thereof is 1.0 or less.

Suitable examples of the electron attractive group having the $\sigma_p$ value of not less than 0.20 include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having the $\sigma_p$ value of 0.20 or more, a heterocyclic group, a halogen atom, an azo group, and a selenocyanate group.

Of these substituents, those capable of having a substituent may further have substituent(s) as described for $R^8$ above.

More specifically, the electron attractive group having the $\sigma_p$ value of not less than 0.20 includes an acyl group (e.g., acetyl, 3-phenylpropanoyl, benzoyl, or 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido) penylcarbamoyl, N-methyl-N-dodecylcarbamoyl, or N-[3-(2,4-di-tert-amylphenoxy)propyl]carbamoyl), an alkoxycarbonyl group (e.g., methoxycarbonyl, ethoxycarbonyl, isopropyloxy carbonyl, tert-butyloxycarbonyl, isobutyloxycarbonyl, butyloxycarbonyl, dodecyloxycarbonyl, or octadecyloxycarbonyl), an aryloxycarbonyl group (e.g., phenoxycarbonyl), a cyano group, a nitro group, a dialkylphosphono group (e.g., dimethylphosphono), a diarylposphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, or octanesulfonyl), an arylsulfonyl group (e.g., benzenesulfonyl, or toluenesulfonyl), a sulfonyloxy group (e.g., methanesulfonyloxy, or toluenesulfonyloxy), an acylthio group (e.g., acetylthio, or benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a thiocyanate group, a thiocarbonyl group (e.g., methylthiocarbonyl, or phenylthiocarbonyl), a halogenated alkyl group (e.g., trifluoromethyl, or heptafluoropropyl), a halogenated alkoxy group (e.g., trifluoromethoxy), a halogenated aryloxy group (e.g., pentafluorophenoxy), a halogenated alkylamino group (e.g., N,N-di-(trifluoromethyl)amino), a halogenated alkylthio group (e.g., difluoromethylthio, or 1,1,2,2-tetrafluoroethylthio), an aryl group substituted with an electron attractive group having the $\sigma_p$ value of not less than 0.20 (e.g., 2,4-dinitrophenyl, 2,4,6-trichlorophenyl, or pentachlorophenyl), a heterocyclic group (e.g., 2-benzoxazolyl, 2-benzothiazolyl, 1-phenyl-2-benzimidazolyl, 5-chloro-1-tetrazolyl, or 1-pyrrolyl), a halogen atom (e.g., chlorine, or bromine), an azo group (e.g., phenylazo), and a selenocyanate group. Of these substituents, those capable of having a substituent may further have substituent(s) as described far $R^8$ above.

Preferred groups represented by $R^6$ or $R^7$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with at least two electron attractive groups having the $\sigma_p$ value of not less than 0.20, and a heterocyclic group. More preferred groups include an alkoxycarbonyl group, a nitro group, a cyano group, an arylsulfonyl group, a carbamoyl group, and a halogenated alkyl group. $R^6$ most preferably represents a cyano group. $R^7$ particularly preferably represents an alkoxycarbonyl group, and most preferably represents a branched chain alkoxycarbonyl group (in particular, a cycloalkoxycarbonyl group).

X represents a hydrogen atom or a group capable of being released upon a coupling reaction with an oxidation product of an aromatic primary amine color developing agent. The group capable of being released includes a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a carbamoyloxy group, a heterocyclic carbonyloxy group, a 5-membered or 6-membered nitrogen-containing heterocyclic group, an imido group, and an arylazo group. These groups may be further substituted with substituent(s) as described for $R^8$ above.

More specifically, the group capable of being released for X includes a halogen atom (e.g., fluorine, chlorine, or bromine), an alkoxy group (e.g., ethoxy, dodecyloxy, methoxyethylcarbamoylmethoxy, carboxypropyloxy, methylsulfonylethoxy, or ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, or 2-carboxyphenoxy), an acyloxy group (e.g., acetoxy, tetradecanoyloxy, or benzoyloxy), an alkyl or aryl sulfonyloxy group (e.g., methanesulfonyloxy, or toluenesulfonyloxy), an acylamino group (for example, dichloroacetylamino, or heptafluorobutyrylamino), an alkyl or aryl sulfonamido group (e.g., methanesulfonamido, trifluoromethanesulfonamido, or p-toluenesulfonamido), an alkoxycarbonyloxy group (e.g., ethoxycarbonyloxy, or benzyloxycarbonyloxy), an aryloxycarbonyloxy group (e.g., phenoxycarbonyloxy), an alkyl, aryl or heterocyclic thio group (e.g., dodecylthio, 1-carboxydodecylthio, phenylthio, 2-butoxy-5-tert-octylphenylthio, or tetrazolylthio), a carbamoylamino group (e.g., N-methylcarbamoylamino, or N-phenylcarbamoylamino), a carbamoyloxy group (e.g., N,N-diethylcarbamoyloxy, N-ethylcarbamoyloxy, or N-ethyl-N-phenylcarbamoyloxy), a heterocyclic carbonyloxy group (e.g., morpholino carbonyloxy, or piperidinocarbonyloxy), a 5-membered or 6-membered nitrogen-containing heterocyclic group (e.g., imidazolyl, pyrazolyl, triazolyl, tetrazolyl, or 1,2-dihydro-2-oxo-1-pyridyl), an imido group (e.g., succinimido, or hydantoinyl), and an arylazo group (e.g., phenylazo, or 4-methoxyphenylazo).

X further represents a releasing group bonded through a carbon atom. In such a case, the coupler may form a bis type coupler obtained by condensation of a 4-equivalent copular with an aldehyde or a ketone. Moreover, X may contain a photographically useful group, for example, a group of development inhibitor or development accelerator.

Preferred groups for X include a halogen atom, an alkoxy group, an aryloxy group, an alkyl or aryl thio group, an alkoxycarbonyloxy group, an aryloxycarbonyloxy group, a carbamoyloxy group, a heterocyclic carbonyloxy group, and a 5-membered or 6-membered nitrogen-containing heterocyclic group bonded to the coupling active position through the nitrogen atom. More preferably, X represents a halogen atom, an alkyl or aryl thio group, an alkoxycarbonyloxy group, an aryloxycarbonyloxy group, a carbamoyloxy group, or a heterocyclic carbonyloxy group. Particularly preferably X represents a carbamoyloxy group or a heterocyclic carbonyloxy group.

In the cyan-dye-forming copular represented by formula (IV), the group represented by $R^6$, $R^7$, $R^8$ or X may be a divalent group to form a dimer or more, or combine with a polymer chain to form a homopolymer or a copolymer. A typical example of a homopolymer or a copolymer formed by combining with a polymer chain includes a homopolymer or a copolymer of an addition polymerizable ethylenically unsaturated compound which has a cyan coupler residue represented by formula (IV). In this case, one or more kinds of a cyan-color-forming repeating unit having the cyan coupler residue represented by formula (IV) may be contained in the polymer and one or more kinds of a non-color-forming ethylene type monomer may be contained therein as a copolymerization component. The cyan-color-forming repeating unit having the cyan coupler residue represented by formula (IV) is preferably represented by the following formula (P):

(P)

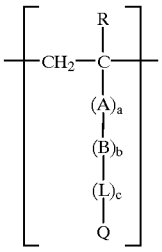

wherein R represents a hydrogen atom, an alkyl group having from 1 to 4 carbon atoms, or a chlorine atom; A represents —CONH—, —COO—, or a substituted or unsubstituted phenylene group; B represents a substituted or unsubstituted alkylene group, a substituted or unsubstituted phenylene group or a substituted or unsubstituted an alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represents 0 or 1; and Q represents a cyan coupler residue formed by eliminating a hydrogen atom from $R^6$, $R^7$, $R^8$ or X in the compound represented by formula (IV).

A preferred polymer is a copolymer of a cyan-color-forming monomer corresponding to the cyan-color-forming repeating unit represented by formula (P) and a non-color-forming ethylene type monomer which is not capable of coupling with an oxidation product of an aromatic primary amine developing agent.

Suitable examples of the non-color-forming ethylene type monomers which are not capable of coupling with an oxidation product of an aromatic primary amine developing agent include, for example, acrylic acid, α-chloroacrylic acid, α-alkylacrylic acid (for example, methacrylic acid), an amide or ester derived from these acrylic acids (for example, acrylamide, methacrylamide, n-butylacrylamide, tert-butylacrylamide, diacetone acrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methylmethacrylate, ethyl methacrylate, n-butyl methacrylate, and β-hydroxy methacrylate), a vinyl ester (for example, vinyl acetate, vinyl propionate, and vinyl laurate), acrylonitrile, methacrylonitrile, an aromatic vinyl compound (for example, styrene and a derivative thereof, for example, vinyl toluene, divinylbenzene, vinyl acetophenone, and sulfostyrene), itaconic acid, citraconic acid, crotonic acid, vinylidene chloride, a vinyl alkyl ether (for example, vinyl ethyl ether), a maleic acid ester, N-vinyl-2-pyrrolidone, N-vinylpyridine, and 2- or 4-vinylpyridine.

Particularly preferred non-color-forming ethylene type monomers are an acrylic acid ester, a methacrylic acid ester, and a maleic acid ester. The non-color-forming ethylene type monomers can be used in combination of two or more thereof. For example, it is suitable to use, in combination, methyl acrylate and butyl acrylate, butyl acrylate and styrene, butyl methacrylate and methacrylic acid, and methyl acrylate and diacetone acrylamide.

As is well known in the polymer coupler art, the ethylene type unsaturated monomer which can be copolymerized with the vinyl type monomer corresponding to the cyan-color-forming repeating unit represented by formula (IV) can be selected so that the physical properties and/or chemical properties of the copolymer formed, for example, solubility, compatibility with a binder for a photographic colloid composition, such as gelatin, flexibility and thermal stability, are favorably affected.

In order to incorporate the cyan-dye-forming coupler according to the present invention into a silver halide photographic light-sensitive material, preferably a red-sensitive silver halide emulsion layer, it is preferred that the cyan coupler is a so-called coupler-in-emulsion type coupler. For such a purpose, at least one of the groups represented by $R^6$, $R^7$, $R^8$ and X is preferably a so-called ballast group (preferably having 10 or more total carbon atoms, more preferably from 10 to 50 total carbon atoms). In particular, $R^8$ is preferably the ballast group.

Of the cyan-dye-forming couplers represented by formula (IV), compounds having a structure represented by formula (V) shown below are more preferred.

(V)

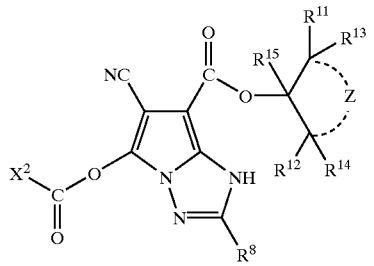

wherein $R^{11}$, $R^{12}$, $R^{13}$, $R^{14}$ and $R^{15}$, which may be the same or different, each represents a hydrogen atom or a substituent; Z represents a non-metallic atomic group necessary to form a 5-membered to 8-membered ring; $R^8$ represents a hydrogen atom or a substituent; and $X^2$ represents a hydrogen atom or a substituent.

In more detail, in formula (V), the substituent represented by $R^{11}$, $R^{12}$, $R^{13}$, $R^{14}$ or $R^{15}$ is preferably a substituted or unsubstituted aliphatic group or a substituted or unsubstituted aryl group.

More specifically, $R^{11}$ and $R^{12}$ each preferably represents an aliphatic group, for example, a straight chain, branched chain or cyclic alkyl group, an aralkyl group, an alkenyl group, an alkinyl group, or a cycloalkenyl group each having from 1 to 36 carbon atoms, specifically, e.g., methyl, ethyl, propyl, isopropyl, tert-butyl, tert-amyl, tert-octyl, tridecyl, cyclopentyl or cyclohexyl. More preferably, the aliphatic group has from 1 to 12 carbon atoms. $R^{13}$, $R^{14}$ and $R^{15}$ each preferably represents a hydrogen atom or an aliphatic group. The aliphatic group is the same as that defined for $R^{11}$ or $R^{12}$ above. $R^{13}$, $R^{14}$ and $R^{15}$ each preferably represents a hydrogen atom.

Z represents a non-metallic atomic group necessary to form a 5-membered to 8-membered ring, the ring may be substituted, or may be a saturated ring, or may contain an unsaturated bond. Preferred non-metallic atoms include a nitrogen atom, an oxygen atom, a sulfur atom or a carbon atom, more preferably a carbon atom.

Examples of the ring formed by Z include, e.g., a cyclopentane ring, a cyclohexane ring, a cycloheptane ring, a cyclooctane ring, a cyclohexene ring, a piperazine ring, an oxane ring and a thiane ring, and the ring may be substituted with substituent(s) as defined for $R^8$ described below.

The preferred ring formed by Z is a cyclohexane ring which may be substituted, and the particularly preferred ring is a cyclohexane ring substituted with an alkyl group having from 1 to 24 carbon atoms at the 4-position thereof (which may be substituted with substituent(s) as defined for $R^8$ described below).

The substituent represented by $R^8$ in formula (V) is the same as that defined for $R^8$ in formula (IV) above. $R^8$ preferably represents an alkyl group or an aryl group, and more preferably a substituted aryl group. With respect to the number of carbon atoms included, the alkyl group preferably has from 1 to 36 carbon atoms, and the aryl group preferably has from 6 to 36 carbon atoms.

Among the aryl groups, those substituted with an alkoxy group at the ortho position to the position bonding to the coupler skeleton are not preferred since light fastness of dyes formed these couplers is poor.

As the substituent for the aryl group, a substituted or unsubstituted alkyl group is preferred, and an substituted alkyl group is more preferred. An unsubstituted alkyl group having from 1 to 30 carbon atoms is particularly preferred.

The substituent represented by $X^2$ is preferably a group capable of accelerating release of the $X^2$-C(=O)O— group at the time of oxidized coupling reaction.

$X^2$ preferably represents a heterocyclic group, an unsubstituted or substituted amino group or an aryl group. A heterocyclic ring for forming the heterocyclic group represented by $X^2$ is preferably a 5-membered to 8-membered ring containing a nitrogen atom, an oxygen atom or a sulfur atom as a hetero atom and having from 1 to 36 carbon atoms. A 5-membered or 6-membered nitrogen-containing heterocyclic ring which is connected to the carbonyl group through the nitrogen atom is more preferred. Among others, the 6-membered nitrogen-containing heterocyclic ring connecting through the nitrogen atom is particularly preferred. The ring may form a condensed ring together with a benzene ring or a heterocyclic ring.

Specific examples of the heterocyclic ring include imidazole, pyrazole, triazole, a lactam compound, piperidine, pyrrolidine, pyrrole, morpholine, pyrazolidine, thiazolidine and pyrazoline. Preferred rings are morpholine and piperidine, and morpholine is particularly preferred.

A substituent for the substituted amino group include an aliphatic group, an aryl group and a heterocyclic group. Suitable examples of the aliphatic group include those described for $R^8$ above. The aliphatic group may be substituted with a cyano group, an alkoxy group (e.g., methoxy), an alkoxycarbonyl group (e.g., ethoxycarbonyl), a chlorine atom, a hydroxy group or a carboxyl group. Of the substituted amino groups, a disubstituted amino group is more preferred than a monosubstituted amino group. As the substituent, an alkyl group is preferred.

The aryl group has preferably from 6 to 36 carbon atoms. A monocyclic aryl group is more preferred. Specific examples of the aryl group include a phenyl, 4-tert-butylphenyl, 2-methylphenyl, 2,4,6-trimethylphenyl, 2-methoxyphenyl, 4-methoxyphenyl, 2,6-dichlorophenyl, 2-chlorophenyl or 2,4-dichlorophenyl group.

It is preferred that the cyan-dye-forming coupler represented by formula (V) according to the present invention has an oil-solubilizing group in its molecule to easily soluble in an organic solvent having a high boiling point and that the coupler per se and a dye formed therefrom upon the oxidized coupling reaction between the coupler and a reducing agent for color formation, i.e., a developing agent are diffusion-resistant in a hydrophilic colloid layer of the photographic material.

The coupler represented by formula (V) may be a dimer or more, in which $R^8$ contains a residue of the coupler represented by formula (V), or may be a homopolymer or a copolymer, in which $R^8$ contains a polymer chain. Typical examples of the homopolymer or copolymer include homopolymers or copolymers formed from an addition polymerizable ethylenically unsaturated compound having a residue of the coupler represented by formula (V). Such polymers may contain one or more kinds of a cyan-color-forming repeating unit containing a residue of the coupler represented by formula (V). The copolymers may contain one or more non-color-forming ethylenic monomers which do not couple with an oxidation product of an aromatic primary amine developing agent, such as acrylic acid esters, methacrylic acid esters or maleic acid esters, as copolymerization components.

Specific examples of the cyan-dye-forming coupler for use in the present invention are set forth below, but the present invention should not be construed as being limited thereto.

CC-1
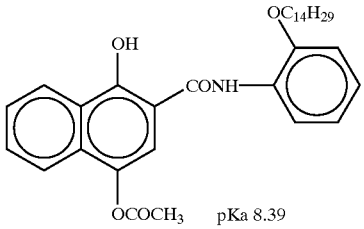
pKa 8.39
CC-2
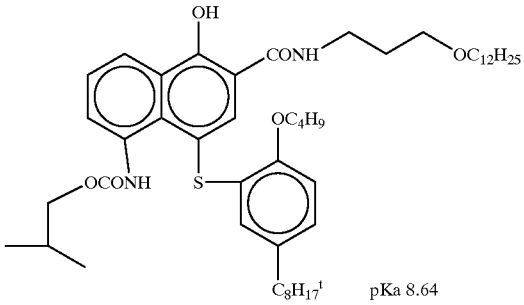
pKa 8.64
CC-3
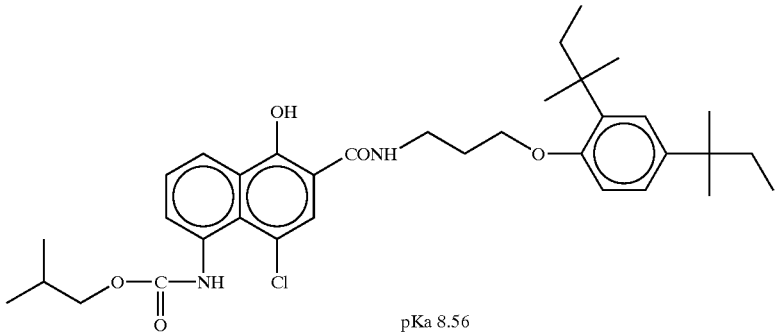
pKa 8.56
CC-4
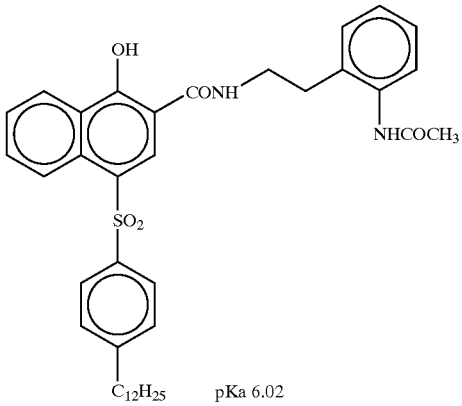
pKa 6.02
CC-5
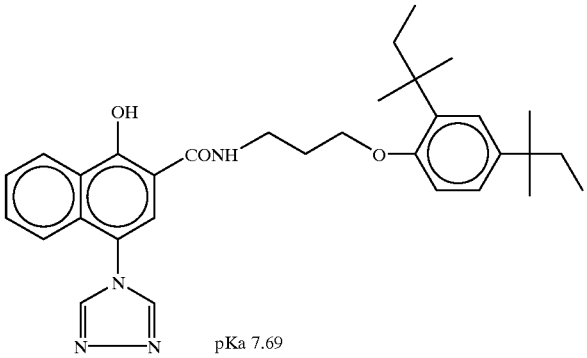
pKa 7.69
CC-6
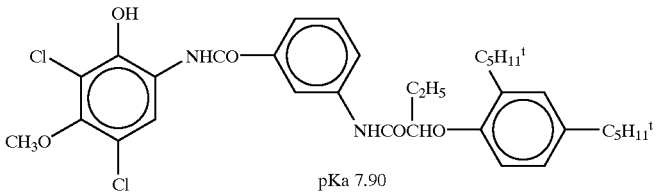
pKa 7.90
(1)
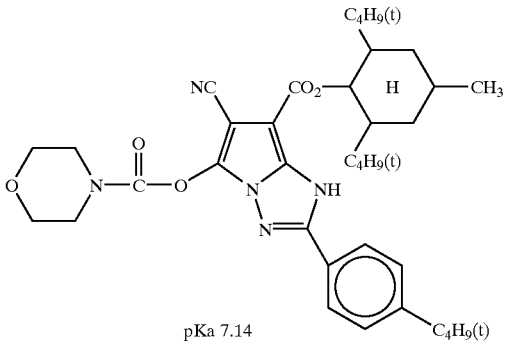
pKa 7.14
(2)
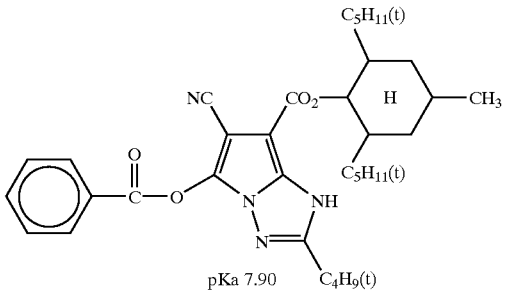
pKa 7.90

-continued
(3)
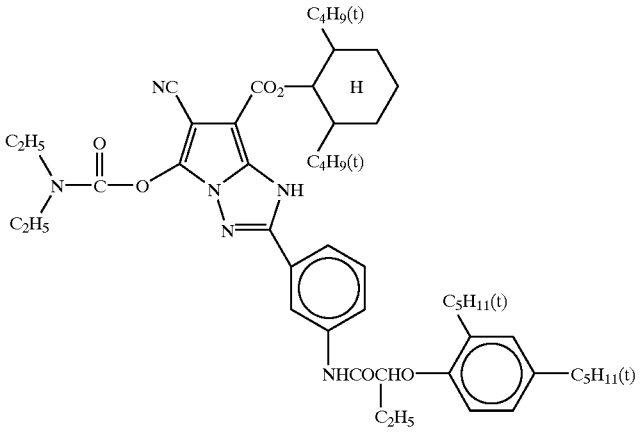
(4)
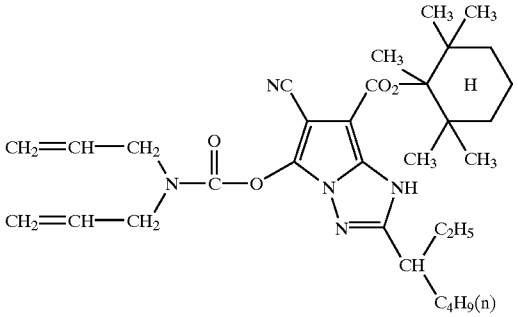
(5)
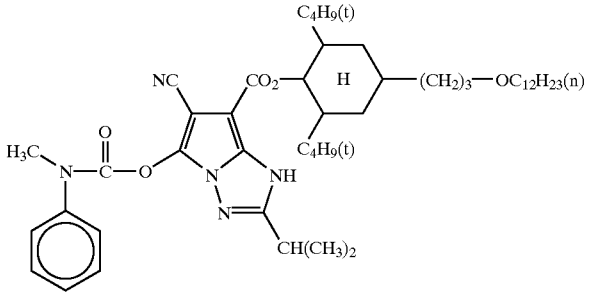
(6)
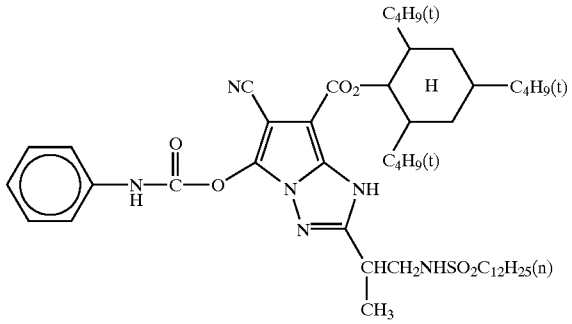
(7)
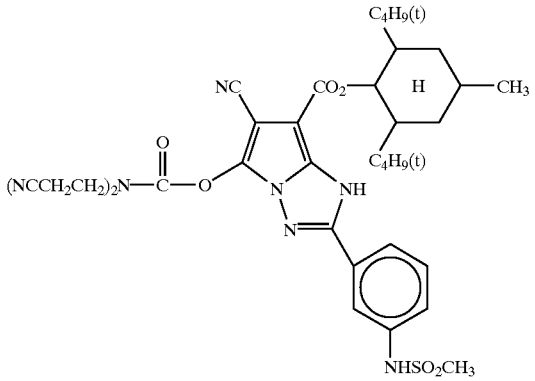
(8)
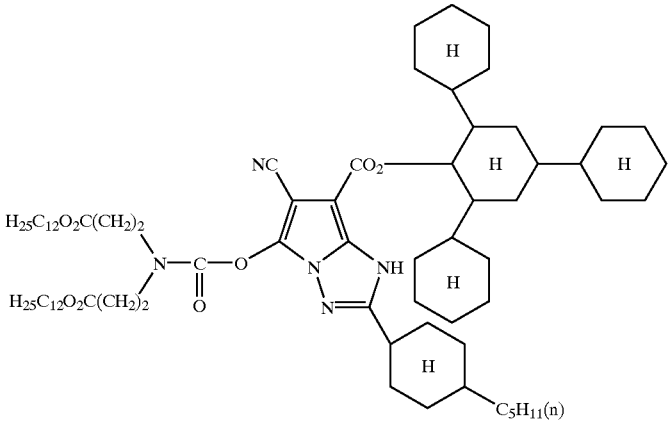

-continued
(9)
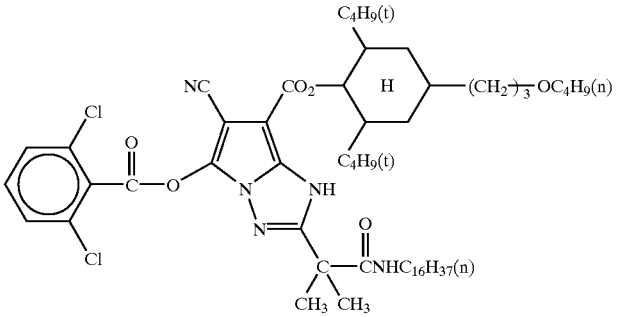
(10)
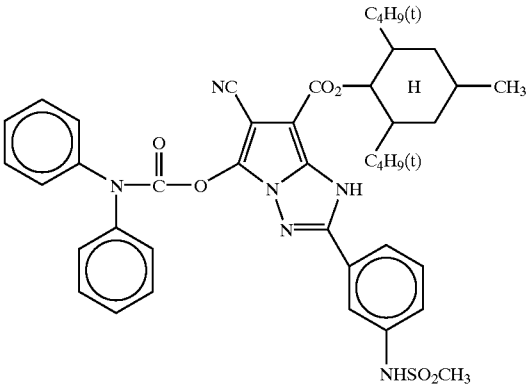
(11)
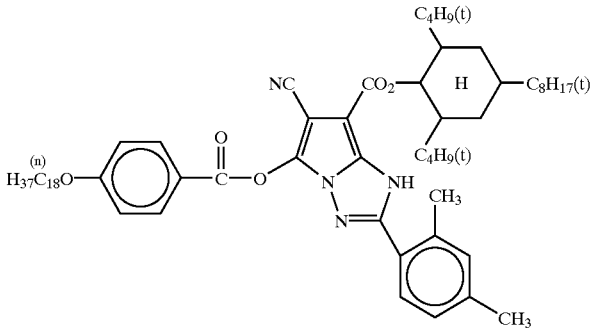
(12)
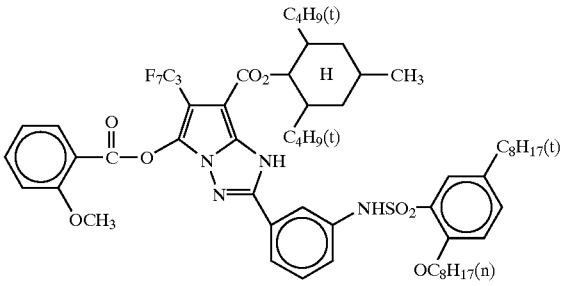
(13)
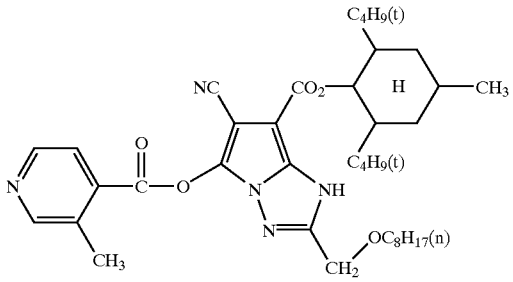
(14)
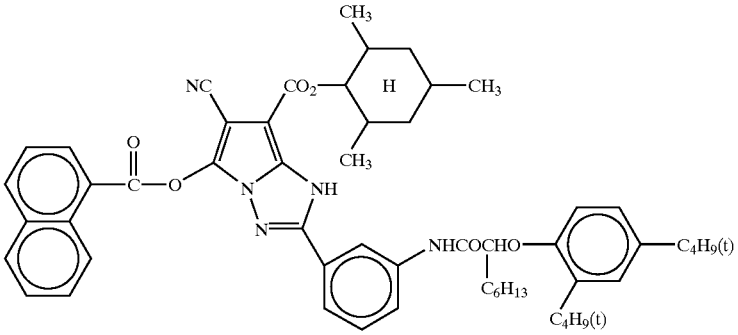

-continued
(15)
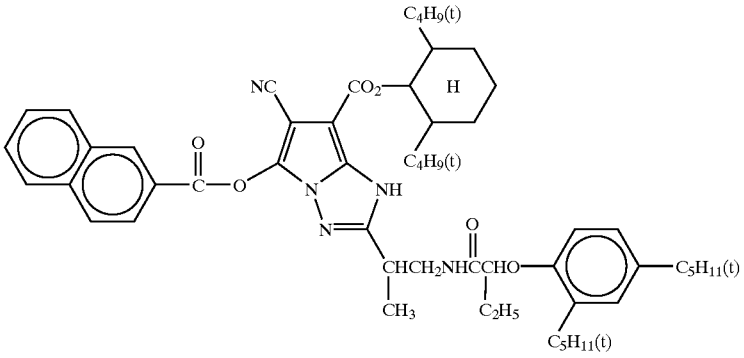
(16)
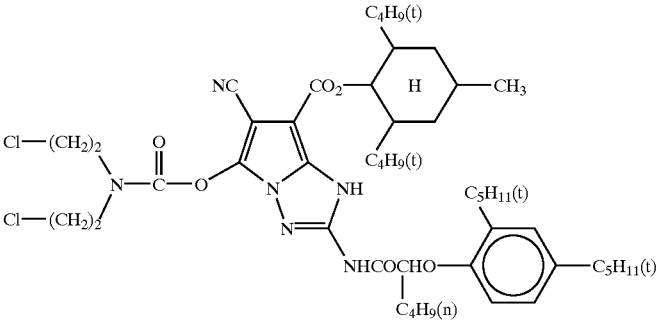
(17)
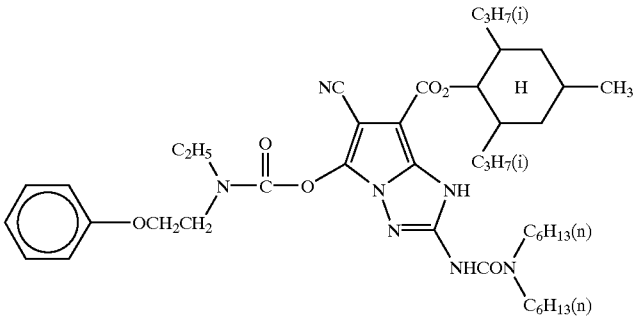
(18)
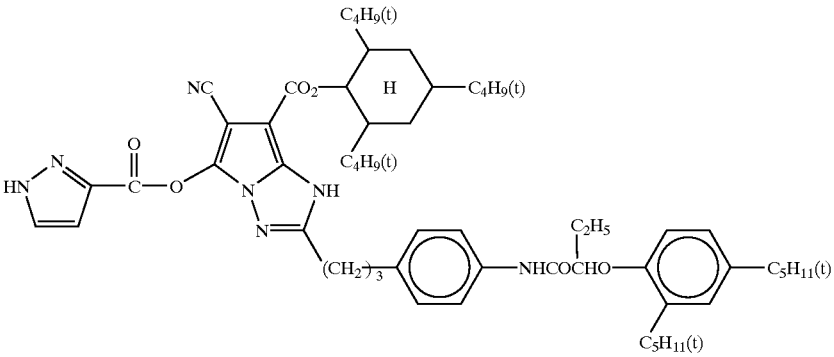

-continued
(19)
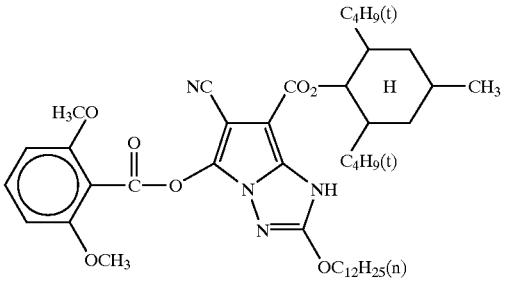
(20)
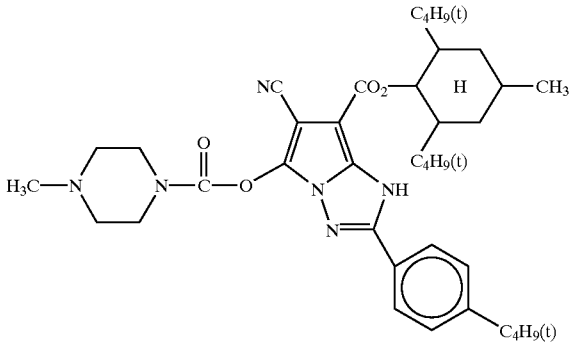
(21)
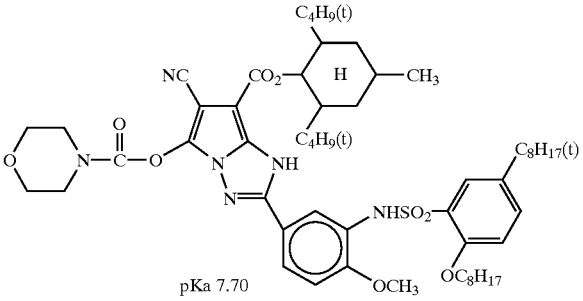
pKa 7.70
(22)
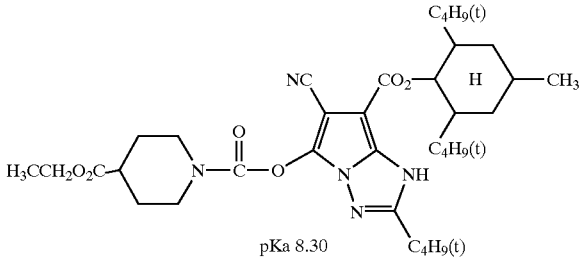
pKa 8.30
(23)
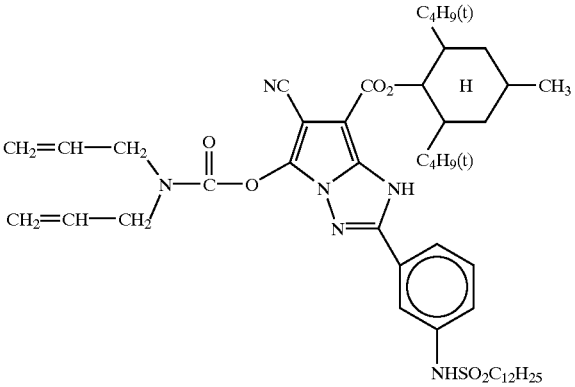
(24)
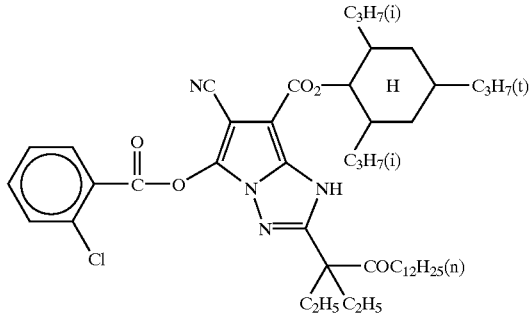
(25)
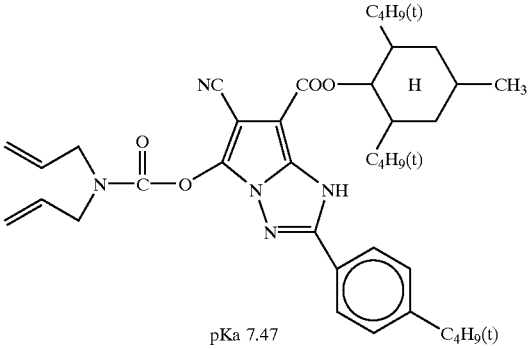
pKa 7.47

-continued
(26)
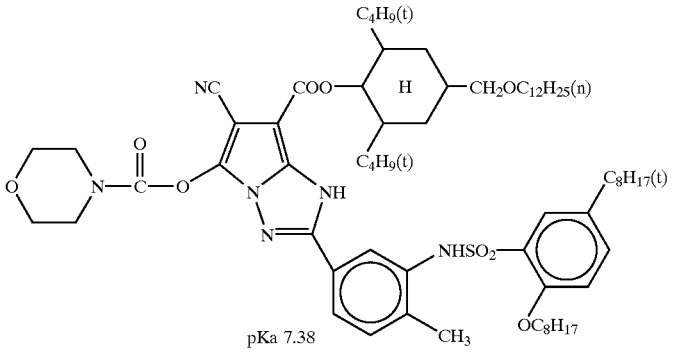
(27)
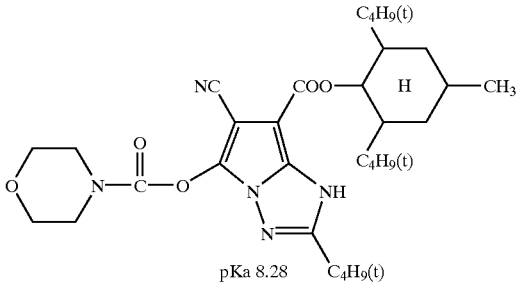
(28)
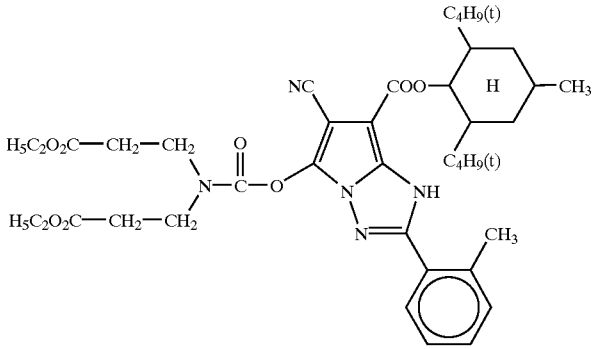
(29)
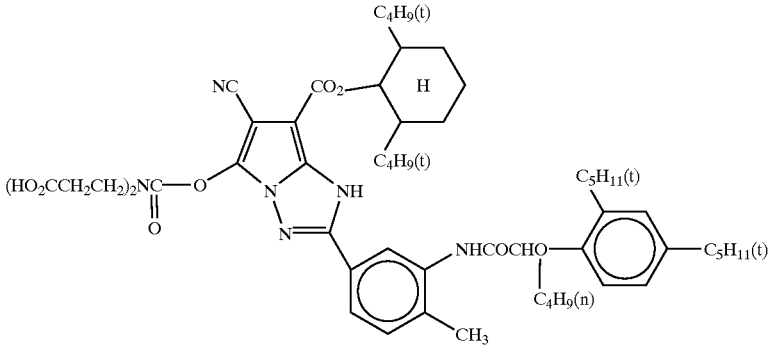
(30)
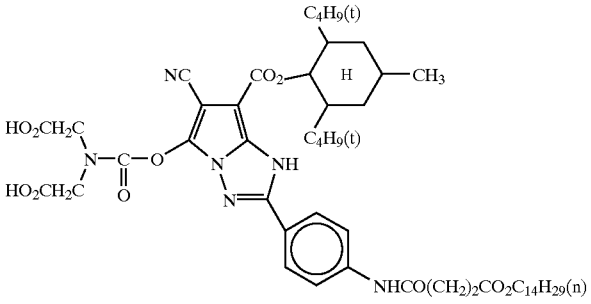
(31)
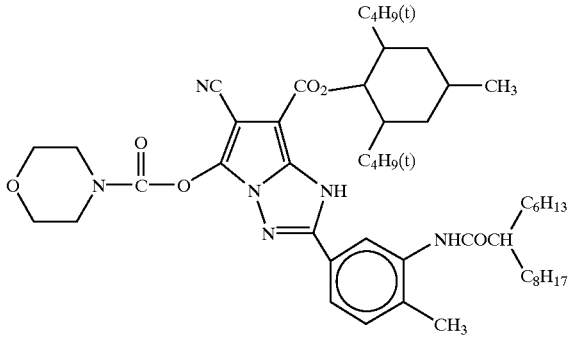

-continued
(32)
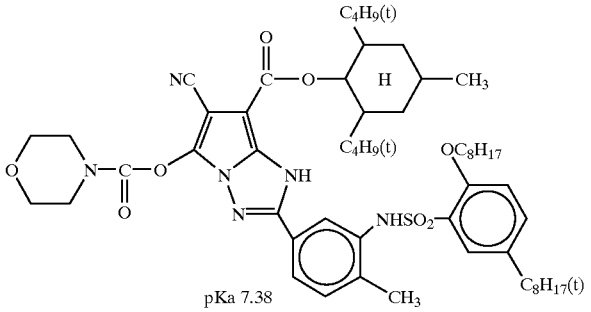
pKa 7.38
(33)
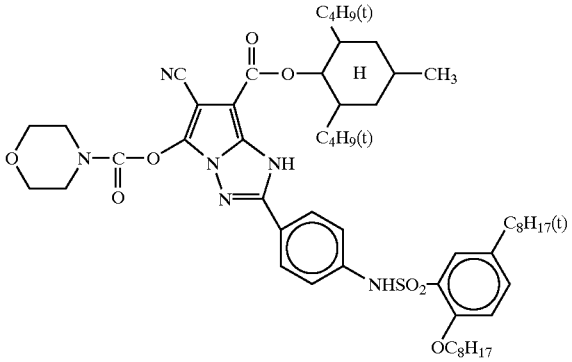
(34)
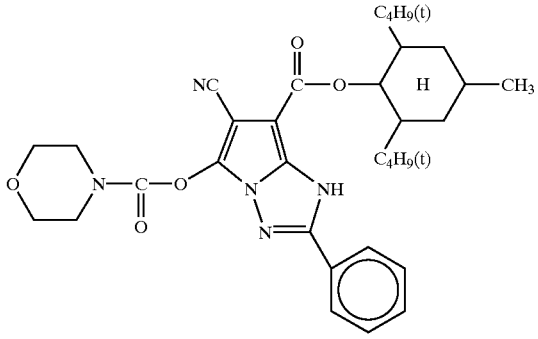
(35)
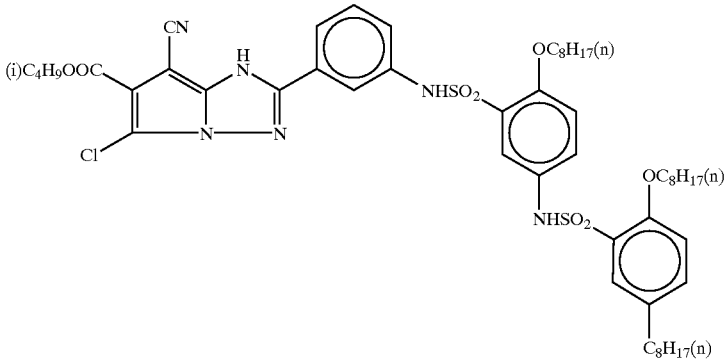
(36)
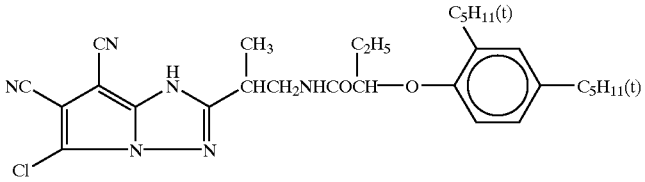
(37)
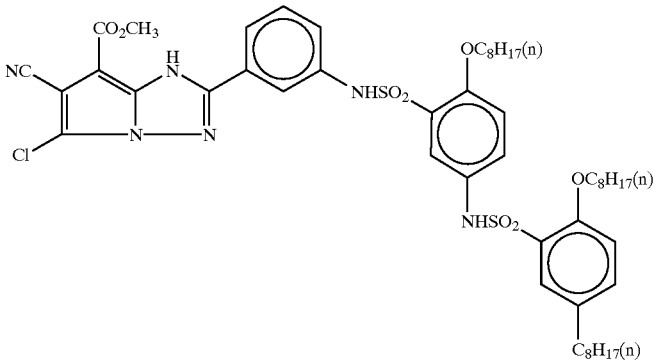

-continued
(38)
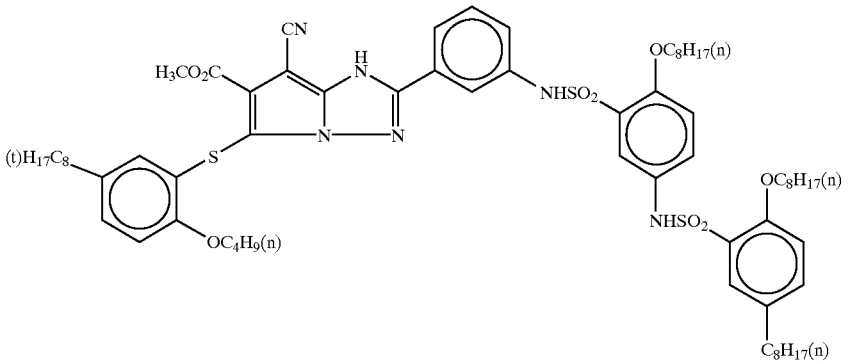
(39)
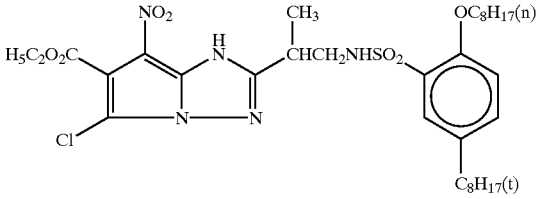
(40)
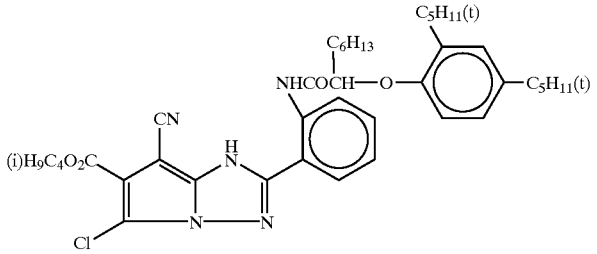
(41)
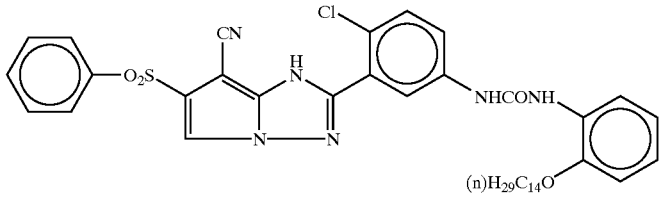
(42)
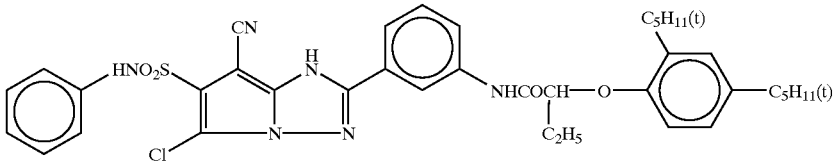
(43)
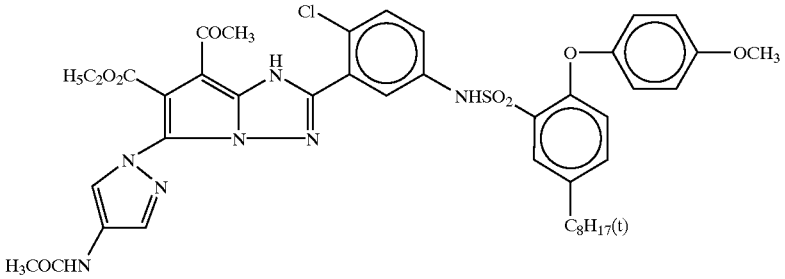
(44)
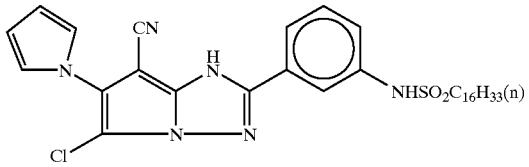
(45)
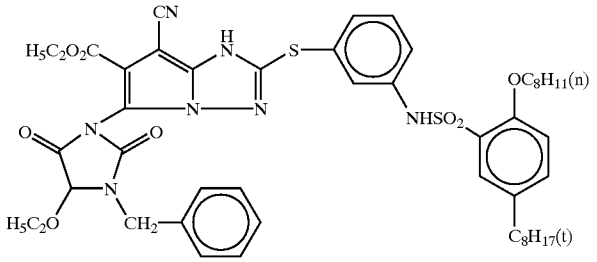

-continued (46)

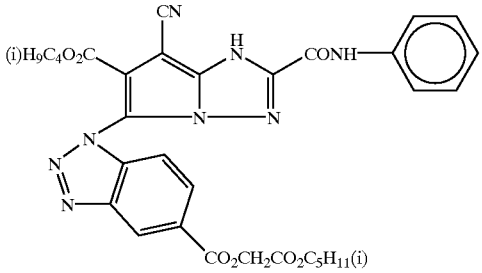

(47)

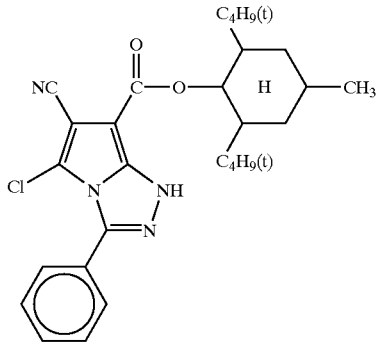

The compound represented by formula (IV) for use in the present invention can be synthesized according to conventionally known methods, for example, methods described in JP-A-5-150423, JP-A-5-255333, JP-A-5-202004 and JP-A-7-48376.

Synthesis examples of the compound represented by formula (IV) are specifically set forth below.

SYNTHESIS EXAMPLE 1

Synthesis of Compound (1)

Compound (1) was synthesized along the route shown below.

Compound (1)

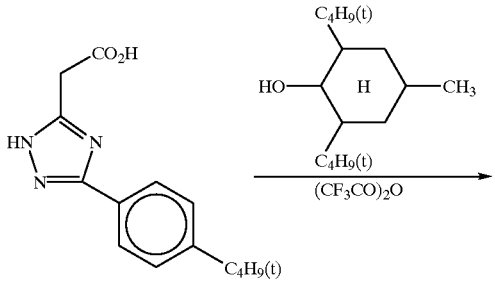

(a)

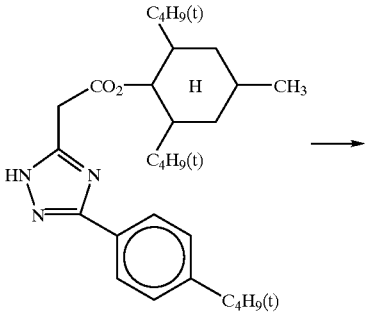

(b)

-continued

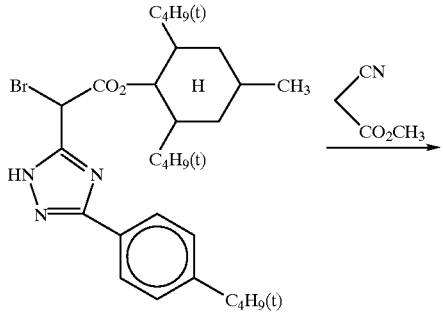

(c)

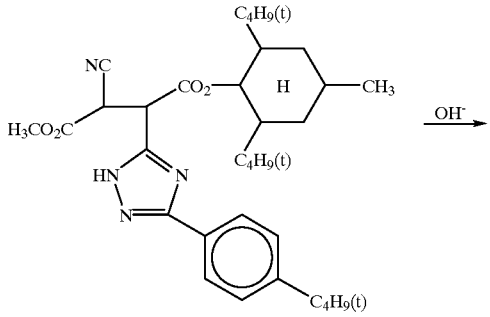

(d)

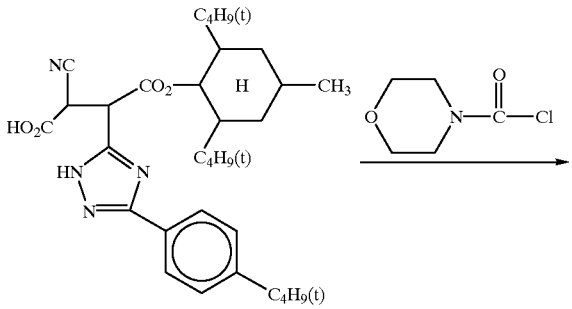

(e)

-continued

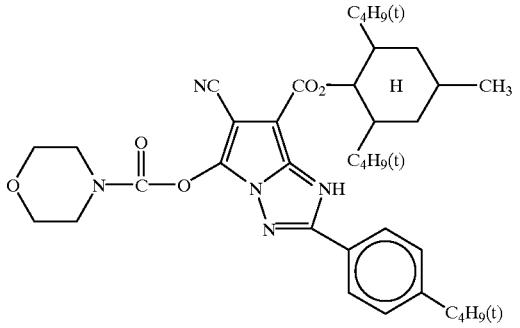

Synthesis of Compound (b)

To 200 ml of an acetonitrile solution containing 17 g (75 mmol) of 2,6-di-tert-butyl-4-methylcyclohexanol was dropwise added 10.6 ml (75 mmol) of trifluoroacetic anhydride at temperature of 0° C., and then 15.6 g (60.4 mmol) of Compound (a) was gradually added thereto. The reaction solution was stirred at room temperature for 2 hours and extracted by adding 300 ml of water and 300 ml of ethyl acetate. The organic layer was washed with an aqueous sodium bicarbonate solution, water and an aqueous sodium chloride solution in order and dried with magnesium sulfate. The solvent was distilled off under a reduced pressure and the residue was recrystallized from acetonitrile to obtain 19.6 g of Compound (b).

Synthesis of Compound (c)

To 200 ml of ethyl acetate solution containing 19.6 g of Compound (b) was added 5 ml of pyridine, and bromine was dropwise added thereto under cooling with ice. The mixture was stirred for one hour and extracted by adding 300 ml of water and 300 ml of ethyl acetate. The ethyl acetate layer was dried with magnesium sulfate. The solvent was distilled off, and the residue was recrystallized by adding acetonitrile to obtain 18.0 g of Compound (c).

Synthesis of Compound (e)

To 20 ml of dimethylacetamide solution containing 2.2 g of methyl cyanoacetate was gradually added 0.8 g of sodium hydride at temperature of 0° C., and the mixture was stirred at room temperature for 30 minutes to prepare Solution S. 50 ml of dimethylacetamide solution containing 10.0 g of Compound (c) dissolved therein was gradually dropwise added to Solution S under cooling with ice. After stirring for one hour, to the reaction solution were added 20 ml of an aqueous solution containing 4 g of sodium hydroxide and 20 ml of methanol, and the mixture was stirred for one hour while maintaining the reaction temperature at 50° C. Then, 200 ml of ethyl acetate was added thereto, and the mixture was neutralized with aqueous hydrochloric acid and washed with water. The ethyl acetate layer was dried with magnesium sulfate and the solvent as distilled off under a reduced pressure to obtain Compound (e) in the crude form.

Synthesis of Compound (1)

To a solution containing 8.0 g of Compound (e) in the crude form dissolved in 40 ml of dimethylacetamide and 6 ml of pyridine was added 4.3 g of morpholinocarbamoyl chloride at temperature of 0° C. The mixture was stirred for 2 hours at room temperature to conduct reaction and poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 6.0 g of Compound (1). A melting point of Compound (1) was 256 to 257° C.

SYNTHESIS EXAMPLE 2

Synthesis of Compound (25)

In the step of Synthesis of Compound (1) described above, 4.5 g of diallylcarbamoyl chloride was used in place of 4.3 g of morpholinocarbamoyl chloride. The mixture was stirred for 2 hours at room temperature to conduct reaction, then poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 5.5 g of Compound (25). A melting point of Compound (25) was 219 to 220° C.

Other compounds of formula (IV) are synthesized in an analogous manner.

The compound represented by formula (I), (II) or (III) is dispersed together with an organic compound, for example, a high boiling point organic solvent, a color mixing preventing agent, an ultraviolet absorber, or a polymer dispersant by means of a dispersion aid such as a surface active agent and introduced into a light-insensitive hydrophilic colloid layer according to the present invention. The amount of the compound used is ordinarily in a range of from 0.1 to 200% by mole, preferably from 1 to 100% by mole, and more preferably from 5 to 50% by mole, of the coated amount of cyan coupler.

It is preferred that the compound represented by formula (I), (II) or (III) is also employed in the cyan-color-forming layer in addition to the light-insensitive hydrophilic colloid layer. In such a case, the amount of the compound used in the cyan-color-forming layer is ordinarily in a range of from 1 to 100% by mole, and preferably from 5 to 50% by mole, of the coated amount of cyan coupler. The compound represented by formula (I), (II) or (III) is also preferably employed in a layer other than the above described layers. In such a case, the total amount of the compound used is preferably in a range of from 1 to 200% by mole, more preferably from 5 to 100% by mole, and yet more preferably from 10 to 50% by mole, of the coated amount of cyan coupler.

The coated amount of cyan coupler according to the present invention may be varied depending on a molecular absorption coefficient thereof, and is preferably in a range of from 0.01 to 1 g/m$^2$, and more preferably from 0.05 to 0.5 g/m$^2$.

In case of using the cyan coupler represented by formula (IV), the coated amount thereof is preferably in a range of from 0.01 to 0.6 g/m$^2$, more preferably from 0.05 to 0.4 g/m$^2$, and yet more preferably from 0.1 to 0.3 g/m$^2$.

A ratio of the amounts of silver halide and the cyan coupler used is varied depending on equivalency of the coupler. Ordinarily, a ratio of Ag/coupler is from 1.5 to 8 in case of a two-equivalent coupler, and from 3 to 16 in case of a four-equivalent coupler. A two-equivalent coupler having a low pKa value is preferably used in the present invention, and in this case a ratio of Ag/coupler is ordinarily in a range of from 1.5 to 8, preferably from 2 to 6, and more preferably from 3 to 5.

In order to incorporate the cyan coupler and other compounds described above into a silver halide photographic light-sensitive material, a conventionally known dispersion method, for example, an oil-droplet-in-water dispersion method using a high boiling point organic solvent described hereinafter or a latex dispersion method can be employed.

In the oil-droplet-in-water dispersion methods, the cyan coupler and other photographically useful compounds are dissolved in a high boiling point organic solvent, and emulsified and dispersed in a hydrophilic colloid, preferably in an aqueous gelatin solution together with a dispersion aid such as a surface active agent using a known apparatus, for example, an ultrasonic dispersing machine, a colloid mill, a homogenizer, a Manton-Gaulin mixer or a high-speed dissolver to form fine particles thereof.

An auxiliary solvent may be additionally employed in order to dissolve the coupler. The auxiliary solvent means an organic solvent which is useful at the time of emulsification and dispersion and which is substantially removed from the photographic light-sensitive material during a drying step of the production thereof. Suitable examples of the auxiliary solvent include an acetate of lower alcohol such as ethyl acetate or butyl acetate, ethyl propionate, secondary butyl alcohol, methyl ethyl ketone, methyl isobutyl ketone, 2-ethoxyethyl acetate, methyl Cellosolve acetate, methyl Carbitol acetate, methyl Carbitol propionate and cyclohexanone.

Further, an organic solvent which is completely miscible with water, for example, methyl alcohol, ethyl alcohol, acetone, tetrahydrofuran or dimethyformamide may be partially employed.

These organic solvents may be used two or more thereof in combination.

For the purpose of improvement in storage stability of the emulsified dispersion, and restraint of changes in photographic characteristics and improvement in storage stability of a coating composition obtained by mixing the emulsified dispersion with a photographic emulsion, the auxiliary solvent is wholly or partially removed from the emulsified dispersion by means of a method, for example, distillation under a reduced pressure, noodle washing, or ultrafiltration, if desired.

The average particle size of the olephilic fine particle dispersion thus-obtained is preferably from 0.04 to 0.50 $\mu$m, more preferably from 0.05 to 0.30 $\mu$m, and yet more preferably from 0.08 to 0.20 $\mu$m. The average grain size can be measured by Coulter Submicron Particle Analyzer Model N4 (manufactured by Coulter Electronics Co., Ltd.)

In the oil-droplet-in-water dispersion method using a high boiling point organic solvent, an amount of the high boiling point organic solvent is appropriately selected. A weight ratio of the high boiling point organic solvent to the total cyan coupler used is preferably from 0.1 to 10.0, more preferably from 0.3 to 7.0, and particularly preferably from 0.5 to 5.0. It is also possible that the high boiling point organic solvent is not used.

The silver halide color photographic light-sensitive material of the present invention can be applied, for example, to a color negative film, a color positive film, a color reversal film, color reversal printing paper, color printing paper or the like, and preferably to color paper.

A transmission type support or a reflective type support is employed as a support for the photographic material of the present invention. Among the transmission type support, a transparent film such as a cellulose triacetate film or a polyethylene terephthalate film, and a polyester film composed of 2,6-naphthalenedicarboxylic acid (NDCA) and ethylene glycol (EG) or composed of NDCA, terephthalic acid and EG having provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers is preferred.

It is preferred that the water-resistant resin layer contains a fluorescent whitening agent. The fluorescent whitening agent may also be dispersed in a hydrophilic colloid layer of the photographic light-sensitive martial. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmission type support and a reflective type support each having provided thereon a hydrophilic colloid layer containing a white pigment may be employed as the reflective type support.

Moreover, a support having a mirror plate reflective metal surface or a secondary diffusion reflective metal surface may be used as the reflective type support.

A silver halide emulsion used in the present invention includes a silver (iodo)chloride emulsion, a silver chloro (iodo)bromide emulsion, and a silver (iodo)bromide emulsion.

A silver chloride or silver chlorobromide emulsion having a silver chloride content of 95 mol % or more is preferably employed in the color photographic light-sensitive material of the present invention in view of rapid processing suitability. Further, a silver halide emulsion having a silver chloride content of 98 mol % or more is more preferred. Of these silver halide emulsions, those having a silver bromide localized phase on the surface of silver chloride grain is particularly preferred, since high sensitivity as well as stabilization of photographic characteristics are achieved.

With respect to the reflective type support, silver halide emulsion, heterogeneous metal ion doped in silver halide grain, stabilizer and antifoggant for silver halide emulsion, chemical sensitization (chemical sensitizer), spectral sensitization (spectral sensitizer), cyan coupler, magenta coupler, yellow coupler, emulsified dispersion method of coupler, color image stabilizer (anti-staining agent), color fading preventing agent, dye (colored layer), gelatin, layer construction of photographic material and pH of coated layer, those described in the patents shown in Table 1 and Table 2 below are preferably used in the present invention.

TABLE 1

| Photographic Element | JP-A-7-104448 | JP-A-7-77775 | JP-A-7-310895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Silver Halide Emulsion | Col. 72, line 29 to Col. 74, line 18 | Col. 44, line 36 to Col. 46, line 29 | Col. 77, line 48 to Col. 80, line 28 |
| Heterogeneous Metal Ion | Col. 74, lines 19 to 44 | Col. 46, line 30 to Col. 47, line 5 | Col. 18, line 29 to Col. 81, line 6 |
| Stabilizer and Antifoggant | Col. 75, lines 9 to 18 | Col. 47, lines 20 to 29 | Col. 18, line 11 to Col. 31, line 37 (particularly, mercapto heterocyclic compound) |
| Chemical Sensitization (Chemical Sensitizer) | Col. 74, line 45 to Col. 75, line 6 | Col. 47, lines 7 to 17 | Col. 81, lines 9 to 17 |

TABLE 1-continued

| Photographic Element | JP-A-7-104448 | JP-A-7-77775 | JP-A-7-310895 |
|---|---|---|---|
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, line 50 to Col. 63, line 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |

TABLE 2

| Photographic Element | JP-A-7-104448 | JP-A-7-77775 | JP-A-7-310895 |
|---|---|---|---|
| Magenta Coupler | Col. 88, lines 4 to 18 | Col. 63, line 31 to Col. 64, line 11 | Col. 32, line 34 to Col. 77, line 44 and Col. 89, lines 32 to 46 |
| Emulsified Dispersion Method of Coupler | Col. 71, line 3 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, lines 38 to Col. 32, line 33 |
| Ph of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91 right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-0355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

Gelatin is preferably employed as a hydrophilic colloid in a photographic layer constituting the photographic light-sensitive material according to the present invention. An amount of heavy metal, for example, iron, copper, zinc or manganese, which is included as an impurity in gelatin, is preferably not more than 5 ppm, more preferably not more than 3 ppm.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the spectrum are employed depending on the demand. For instance, a red light emitting material, a green light emitting material and a blue light emitting material are used individually or a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adapted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, and at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-6}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. JP-A-2-207250 discloses that in processing the light- sensitive material any known methods and known processing solutions as described in Research Disclosure 17643, pages 28 to 30 can be applied. This photographic processing may be carried out through photographic processing that forms a silver image or may be carried out by directly forming a dye image, so long as a color image can be finally obtained. The processing temperature is usually preferably from 18° C. to 50° C., but temperatures lower than 18° C. and temperatures higher than 50° C. may be also employed.

JP-A-2-207250 further discloses that there is no particular limitation on methods for the color photographic processing, and various methods can be employed. For example, representative examples thereof include: a system in which color development and bleach-fixation processing are performed after exposure and then water washing and stabilization processing are performed as needed; a system in which color development, bleaching, and fixation are separately performed after exposure and then water washing and stabilization processing are performed as needed; a system in which after developing with a developing solution containing a black-and-white developing agent and performing uniform exposure, color development and bleach-fixation processing are carried out and then water washing and stabilization processing are performed as needed; and a system in which after developing with a developing solution containing a black-and-white developing agent, which is performed after exposure, and further developing with a color developing solution containing a fogging agent (e.g., sodium boron hydride) , a bleach-fixation processing is performed and then water washing and stabilization processing are performed as needed.

JP-A-2-207250 discloses examples of the aromatic primary amine color developing agent employed in the color developing solution as including those known and widely used in various color photographic processing. Such developing agents include aminophenol derivatives and p-phenylenediamine derivatives. Preferred are p-phenylenediamine derivatives and examples thereof are shown below, but are not limited thereto.

Z-1: N,N-diethyl-p-phenylenediamine

Z-2: 2-amino-5-diethylaminotoluene

Z-3: 2-amino-5-(N-ethyl-N-laurylamino)toluene

Z-4: 4-(N-ethyl-N-(β-hydroxyethyl)amino)aniline

Z-5: 2-methyl-4-(N-ethyl-N-(3-hydroxyethyl)amino) aniline

Z-6: 3-methyl-4-amino-N-ethyl-N-(β-methane sulfonamidoethyl) aniline

Z-7: N-(2-amino-5-diethylaminophenylethyl)methane sulfonamide

Z-8: N,N-dimethyl-p-phenylenediamine

Z-9: 4-amino-3-methyl-N-ethyl-N-methoxyethylaniline

Z-10: 4-amino-3-methyl-N-ethyl-N-β-ethoxyethylaniline

Z-11: 4-amino-3-methyl-N-ethyl-N-β-butoxyethylaniline.

As preservatives in a developing solution, the compounds described in the patents set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in JP-A-8-234388 and Japanese Patent Application Nos. 7-334190, 7-334192, 7-334197 and 7-344396.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in JP-A-8-297354 and Japanese Patent Application No. 7-334202 is preferably employed.

According to the activator method, the photographic material is ordinarily subjected to a desilvering treatment after the treatment with the activator solution. However, in the image amplification process using the photographic material having a reduced coating amount of silver, the desilvering treatment is omitted and a simple treatment such as washing with water or stabilizing treatment is conduced. Further, in a system wherein an image information is read from a photographic material by a scanner, the processing method omitting the desilvering treatment can be adopted, even when a photographic light-sensitive material having a large coating amount of silver such as a photographic light-sensitive martial for photographing is processed.

Processing elements and processing methods for the activator treatment, desilvering (bleaching/fixing), water washing and stabilizing for use in the present invention include those known in the art. Preferably, those described in *Research Disclosure*, September 1994, Item 36544, pages 536 to 541 and JP-A-8-234388 are employed.

The present invention will be explained in greater detail with reference to the following examples, but the present invention should not be construed as being limited thereto.

EXAMPLE 1

A surface of a paper support laminated with a polyethylene terephthalate resin on both sides was subjected to a corona discharge treatment. On the surface subjected to the corona discharge treatment was provided a gelatin undercoat layer containing sodium dodecylbenzenesulfonate, and photographic constituent layers of the first layer to the seventh layer described below were coated in order thereon to prepare a silver halide color photographic light-sensitive material which was designated Sample 001. Coating solutions of the photographic constituent layers were prepared as follows.

Preparation of Coating Solution for Fifth Layer:

A solution containing 140 g of Cyan Coupler (ExC-1), 120 g of Color Image Stabilizer (Cpd-1), 5 g of Color Image Stabilizer (Cpd-8), 105 g of Solvent (Solv-10), 55 g of Solvent (Solv-6), and 360 ml of ethyl acetate was emulsified and dispersed in 1,000 g of a 10% aqueous gelatin solution containing 300 ml of a 10% aqueous solution of sodium dodecylbenzenesulfonate to prepare Emulsified Dispersion C.

Separately, Silver Chlorobromide Emulsion C was prepared (a cubic form, a mixture in a ratio of 1/4 (silver mol ratio) of a large grain size emulsion having an average grain size of 0.50 $\mu$m and a small grain size emulsion having an average grain size of 0.41 $\mu$m, variation coefficients of the grain size distribution being 0.09 and 0.11, respectively, both of them being composed of silver chloride substrate grains having 0.8 mol % of silver bromide localized in a part of their surface). The red-sensitive Sensitizing Dyes G and H shown below were added each in an amount of $6.0\times10^{-5}$ mol per mol of silver to the large grain size emulsion, and each in an amount of $9.0\times10^{-5}$ mol per mol of silver to the small grain size emulsion. The silver chlorobromide emulsion was subjected optimally to chemical ripening by adding a sulfur sensitizer and a gold sensitizer.

Emulsified Dispersion C described above was mixed with Silver Chlorobromide Emulsion C and the mixture was dissolved to prepare a coating solution for the fifth layer having the composition shown below. A coating amount of the silver halide emulsion is indicated by the coating amount in terms of silver.

The coating solutions for the first to fourth and sixth to seventh layers were prepared in a manner similar to the coating solution for the fifth layer. 1-Oxy-3,5-dichloro-s-triazine sodium salt was used as a gelatin hardening agent in each layer.

Further, Preservatives (Cpd-12), (Cpd-13), (Cpd-14) and (Cpd-15) shown below were added to each layer so that the total coating amount became 15.0 mg/m$^2$, 60.0 mg/m$^2$, 5.0 mg/m$^2$ and 10.0 mg/m$^2$, respectively.

The spectral sensitizing dyes used for the silver chlorobromide emulsions of the light-sensitive layers are shown below.

Sensitizing Dyes for Blue-Sensitive Emulsin Layer:

Sensitizing Dye A

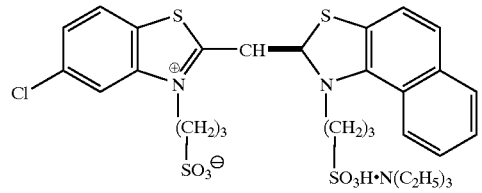

Sensitizing Dye B

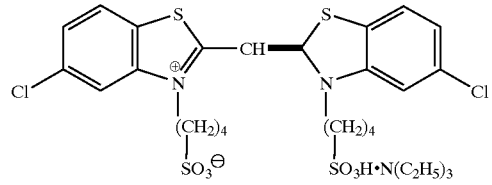

Sensitizing Dye C

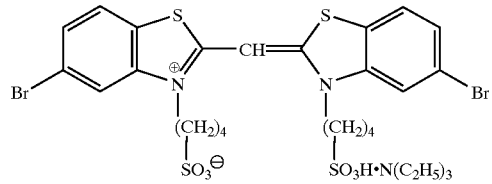

(each was used in an amount of $1.4\times10^{-4}$ mol per mol of the silver halide for the large grain size emulsion and in an amount of $1.7\times10^{-4}$ mol per mol of the silver halide for the small grain size emulsion.)

Sensitizina Dyes for Green-Sensitive Emulsion Layer:

Sensitizing Dye D

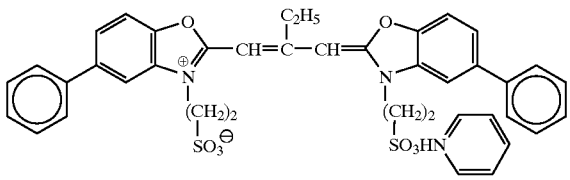

Sensitizing Dye E

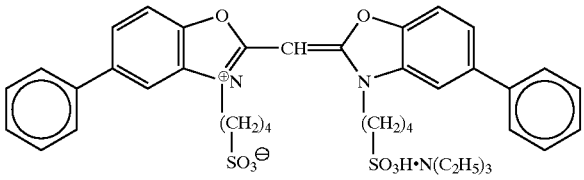

Sensitizing Dye F

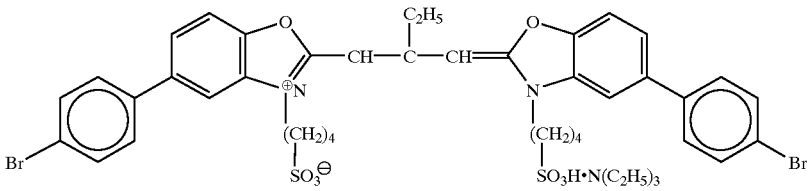

(Sensitizing Dye D was used in an amount of $3.0\times10^{-4}$ mol per mol of the silver halide for the large grain size emulsion and in an amount of $3.6\times10^{-4}$ mol per mol of the silver halide for the small grain size emulsion; Sensitizing Dye E was used in an amount of $4.0\times10^{-5}$ mol per mol of the silver halide for the large grain size emulsion and in an amount of $7.0\times10^{-5}$ mol per mol of the silver halide for the small grain size emulsion; and Sensitizing Dye F was used in an amount of $2.0\times10^{-4}$ mol per mol of the silver halide for the large grain size emulsion and in an amount of $2.8\times10^{-4}$ mol per mol of the silver halide for the small grain size emulsion.)

Sensitizing Dyes for Red-Sensitive Emulsion Layer:

Sensitizing Dye G

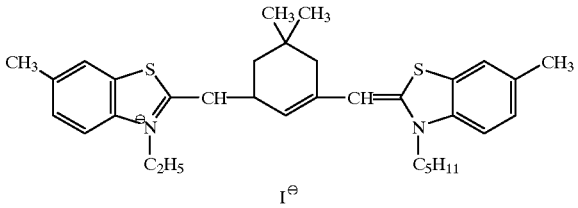

Sensitizing Dye H

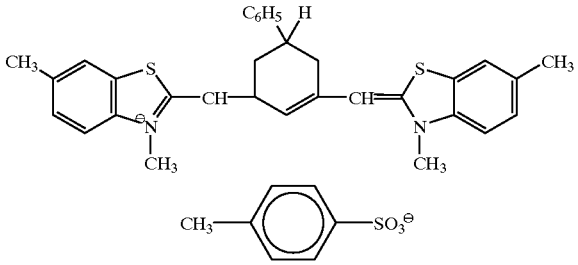

(each was used in an amount of $6.0\times10^{-5}$ mol per mol of the silver halide for the large grain size emulsion and in an amount of $9.0\times10^{-5}$ mol per mol of the silver halide for the small grain size emulsion.)

Further, Compound shown below was added to the red-sensitive emulsion layer in an amount of $2.6\times10^{-3}$ mol per mol of silver halide.

Compound

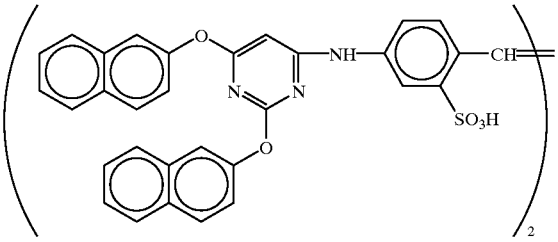

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide. Also, the mercaptotetrazole compound was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes (in the parentheses, the coating amounts thereof being shown) were added to the emulsion layers for the purpose of preventing irradiation.

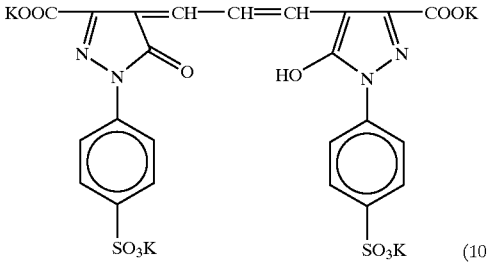

(10 mg/m$^2$)

and

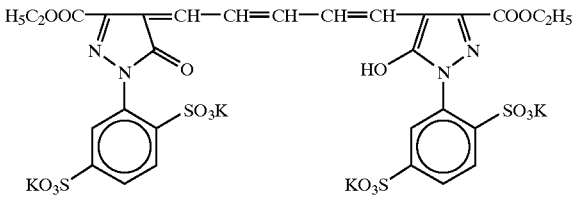

(40 mg/m$^2$)

Layer Construction

The composition of each layer is described below. The numeral represents the coating amount (g/m$^2$). The numeral for silver halide emulsion represents the coating amount in terms of silver.

Support

Polyethylene terephthalate resin-laminated paper containing a white pigment ($TiO_2$ in an amount of 16 wt % and ZnO in an amount of 4 wt %) and a bluish dye (ultramarine) in the polyethylene terephthalate resin layer on the side of the first layer.

| | |
|---|---|
| First Layer (blue-sensitive emulsion layer) | |
| Silver Chlorobromide Emulsion A (a cubic form, a mixture in a ratio of 3/7 (silver mol ratio) of a large grain size emulsion having an average grain size of 0.88 μm and a small grain size emulsion having an average grain size of 0.70 μm; variation coefficients of the grain size distribution being 0.08 and 0.10, respectively, both of them containing 0.3 mol % of silver bromide localized at a part of the surface of each grain having silver chloride as substrate) | 0.27 |
| Gelatin | 1.43 |
| Yellow Coupler (ExY) | 0.61 |
| Color Image Stabilizer (Cpd-1) | 0.08 |
| Color Image Stabilizer (Cpd-2) | 0.04 |
| Solvent (Solv-1) | 0.22 |
| Second Layer (color-mixing preventing layer) | |
| Gelatin | 0.99 |
| Color Mixing Preventing Agent (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |

-continued

| | |
|---|---|
| Third Layer (green-sensitive emulsion layer) | |
| Silver Chlorobromide Emulsion B (a cubic form, a mixture in a ratio of 1/3 (silver mol ratio) of a large grain size emulsion having an average grain size of 0.55 μm and a small grain size emulsion having an average grain size of 0.39 μm; variation coefficients of the grain size distribution being 0.10 and 0.08, respectively, both of them containing 0.8 mol % of silver bromide localized at a part of the surface of each grain having silver chloride as substrate) | 0.13 |
| Gelatin | 1.35 |
| Magenta Coupler (ExM) | 0.12 |
| Ultraviolet Absorber (UV-1) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.08 |
| Color Image Stabilizer (Cpd-8) | 0.01 |
| Solvent (Solv-4) | 0.30 |
| Solvent (Solv-5) | 0.15 |
| Fourth Layer (color-mixing preventing layer) | |
| Gelatin | 0.72 |
| Color Mixing Preventing Agent (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Ultraviolet Absorber (UV-B) | 0.04 |
| Fifth Layer (red-sensitive emulsion layer) | |
| Silver Chlorobromide Emulsion C (a cubic form, a mixture in a ratio of 1/4 (silver mol ratio) of a large grain size emulsion having an average grain size of 0.50 μm and a small grain size emulsion having an average grain size of 0.41 μm,; variation coefficients of the grain size distribution being 0.09 and 0.11, respectively, both of them containing 0.8 mol % of silver bromide localized at a part of the surface of each grain having silver chloride as substrate) | 0.18 |
| Gelatin | 1.20 |
| Cyan Coupler (ExC-1) | 0.28 |
| Color Image Stabilizer (Cpd-1) | 0.24 |
| Color Image Stabilizer (Cpd-8) | 0.01 |
| Solvent (Solv-10) | 0.21 |
| Solvent (Solv-6) | 0.11 |
| Sixth Layer (ultraviolet absorbing layer) | |
| Gelatin | 0.64 |
| Ultraviolet Absorber (UV-2) | 0.39 |
| Color Image Stabilizer (Cpd-7) | 0.05 |
| Solvent (Solv-8) | 0.05 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surface Active Agent (Cpd-11) | 0.01 |

The compounds used for preparing the composition of each layer described above are shown below.

(ExM) Magenta Coupler

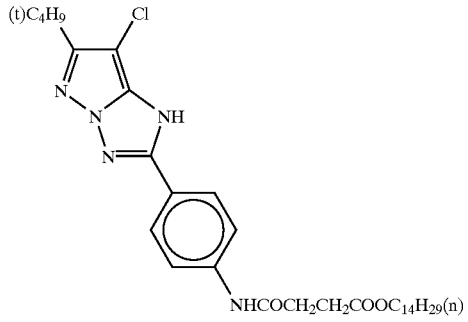

(ExM) Yellow Coupler

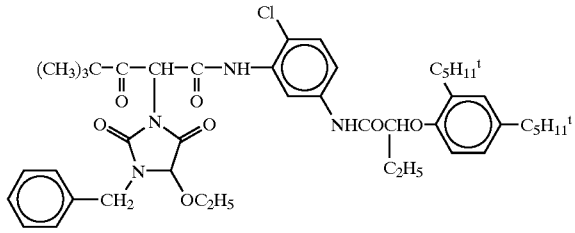

(ExC-1) Cyan Coupler

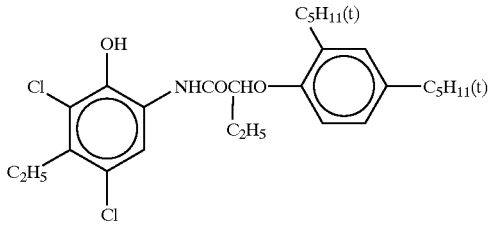

(Cpd-1) Coupler Image Stabilizer

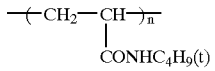

average molecular weight: 60,000

(Cpd-2) Color Image Stabilizer

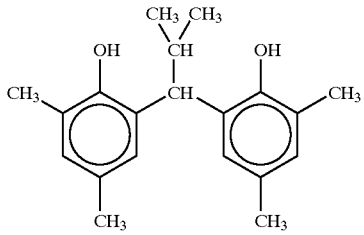

(Cpe-3) Color Image Stabilizer

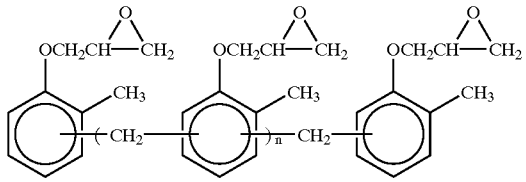

n = 7 to 8 (average value)

-continued (Cpd-4) Color Mixing Preventing Agent

A 1/1/1 mixture by weight ratio of

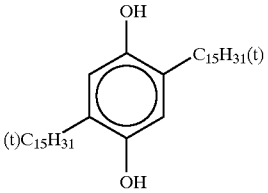

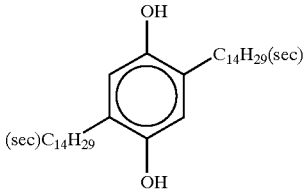

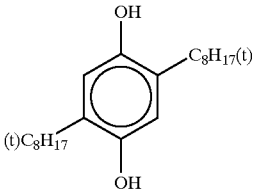

(Cpd-5) Color Image Stabilizer

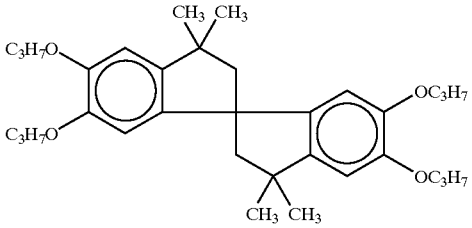

(Cpd-6) Color Image Stabilizer

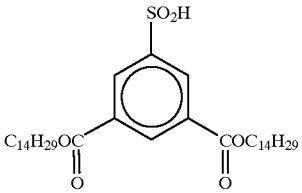

(Cpd-7) Color Image Stabilizer

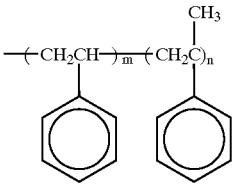

number average molecular weight: 600 m/n = 10/90

(Cpd-8) Color Image Stabilizer

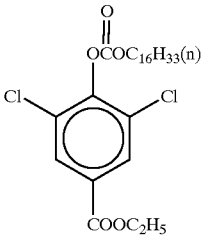

(Cpd-9) Color Image Stabilizer

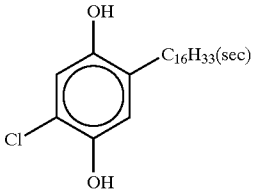

-continued (Cpd-10) Color Image Stabilizer

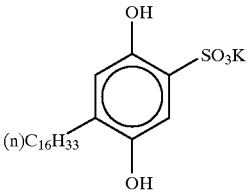

(Cpd-11) Surface Active Agent

A 7/3 mixture by weight ratio of

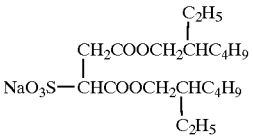

and

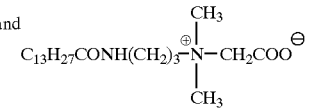

(Cpd-12) Preservative

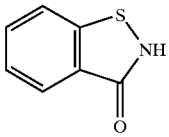

(Cpd-13) Preservative

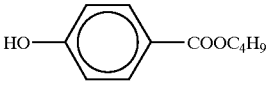

(Cpd-14) Preservative

A 1/1/1/1 mixture by weight ratio of a, b, c and d

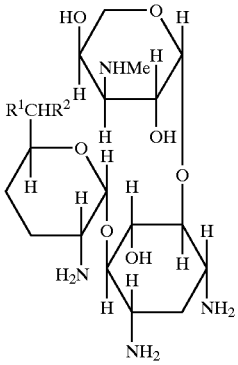

| | $R^1$ | $R^2$ |
|---|---|---|
| a | —Me | —NHMe |
| b | —Me | —$NH_2$ |
| c | —H | —$NH_2$ |
| d | —H | —NHMe |

(Cpd-15) Preservative

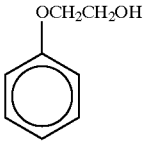

(Cpd-16) Color Image Stabilizer

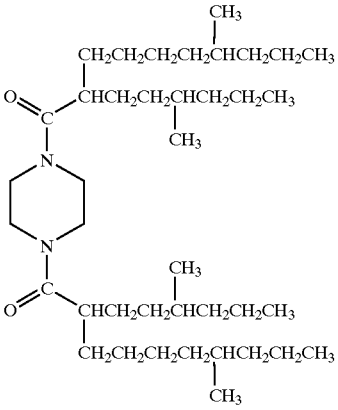

-continued (UV-1) Ultraviolet Absorber

A 1/3/4 mixture by weight ratio of (1), (2) and (3)

(1)

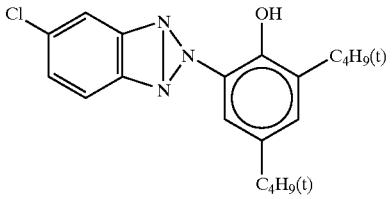

(2)

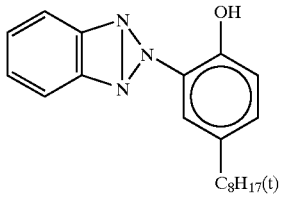

(3)

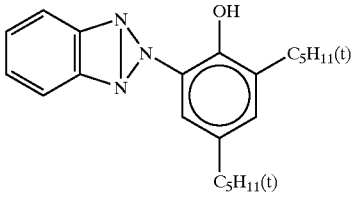

(UV-2) Ultraviolet Absorber

A 1/2/2/3/1 mixture by weight ratio of (1), (2), (3), (4) and ( 5)

(1)

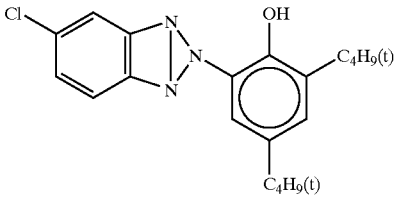

(2)

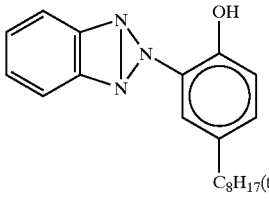

(3)

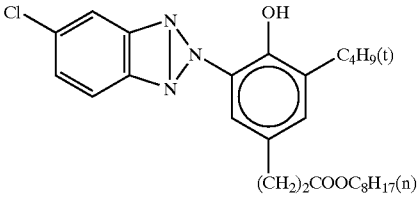

(4)

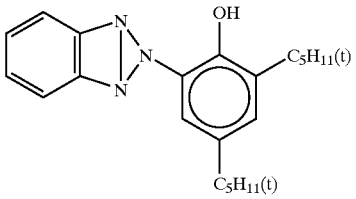

-continued (5)

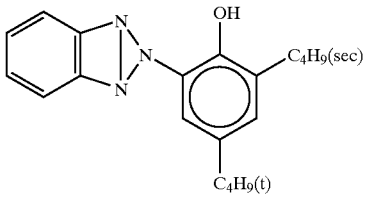

(Solv-1) Solvent

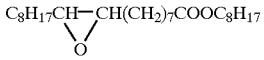

(Solv-2) Solvent

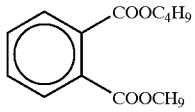

(Solv-3) Solvent

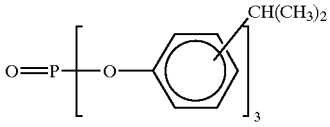

(Solv-4) Solvent

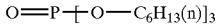

(Solv-5) Solvent

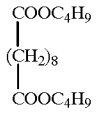

(Solv-6) Solvent

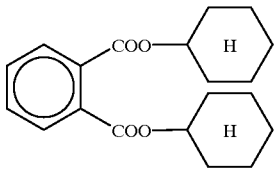

(Solv-7) Solvent

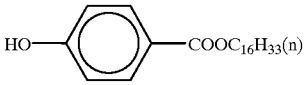

(Solv-8) Solvent

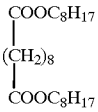

(Solv-9) Solvent

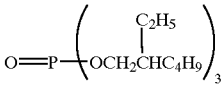

(Solv-10) Solvent

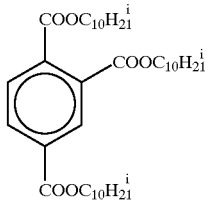

Samples 002 to 020 were prepared in the same manner as in Sample 001 except for replacing the cyan coupler used in the fifth layer with each of the cyan couplers shown in Table 3 below and adding each of the compounds shown in Table 3 below to the second layer and fourth layer in the total amount of 20 mol % of the amount of the cyan coupler. The coating amount of the cyan coupler was so adjusted that the maximum color density of the cyan-color-forming layer in each sample became about 2.5.

TABLE 3

| Sample No. | Cyan Coupler | pKa | Additive for 2nd Layer and 4th Layer | C-stain | ΔD | Remarks |
|---|---|---|---|---|---|---|
| 001 | ExC-1 | 9.14 | — | 0.011 | — | Comparison |
| 002 | " | | 55 | 0.009 | −0.002 | " |
| 003 | C-2 | 9.90 | — | 0.009 | — | " |
| 004 | " | | 55 | 0.008 | −0.001 | " |
| 005 | C-3 | 9.91 | — | 0.021 | — | " |
| 006 | " | | 55 | 0.020 | −0.001 | " |
| 007 | C-4 | 10.27 | — | 0.018 | — | " |
| 008 | " | | 55 | 0.017 | −0.001 | " |
| 009 | C-5 | 7.90 | — | 0.025 | — | " |
| 010 | " | | 55 | 0.008 | −0.017 | Present Invention |
| 011 | C-6 | 8.39 | — | 0.022 | — | Comparison |
| 012 | " | | 55 | 0.010 | −0.012 | Present Invention |
| 013 | C-7 | 8.56 | — | 0.019 | — | Comparison |
| 014 | " | | 55 | 0.010 | −0.009 | Present Invention |
| 015 | C-8 | 6.02 | — | 0.046 | — | Comparison |
| 016 | " | | 55 | 0.014 | −0.032 | Present Invention |
| 017 | (1) | 7.14 | — | 0.035 | — | Comparison |
| 018 | " | | 55 | 0.010 | −0.025 | Present Invention |
| 019 | (27) | 8.28 | — | 0.018 | — | Comparison |
| 020 | " | | 55 | 0.006 | −0.012 | Present Invention |

C-2

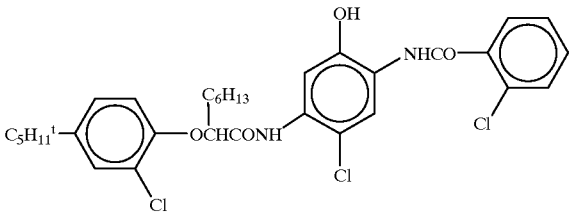

C-3

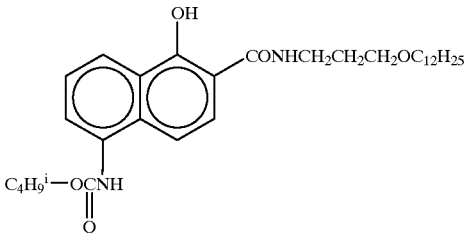

C-4

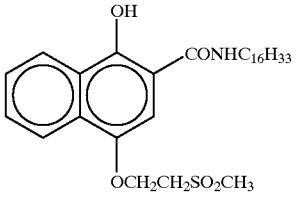

-continued

C-5

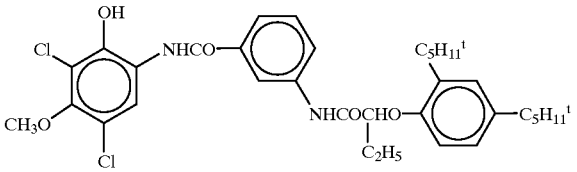

C-6

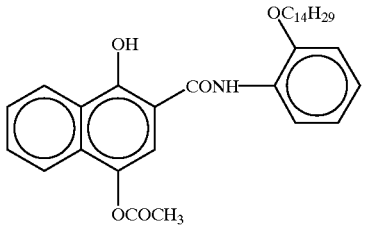

C-7

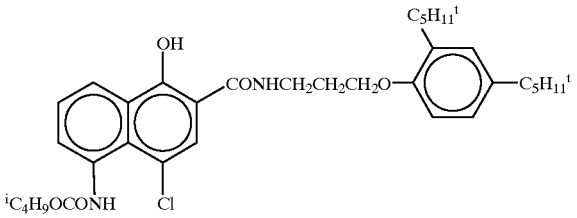

C-8

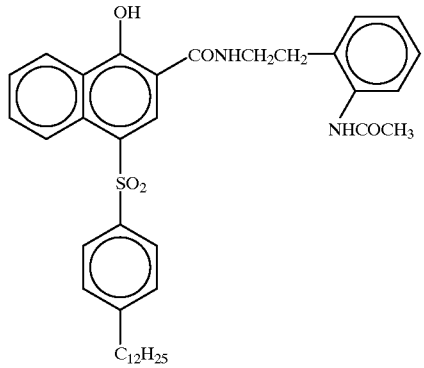

Sample 001 was cut in a roll of a 127 mm width and subjected to imagewise exposure and continuous processing (running processing) according to the following processing steps using a printer processor (PP1820V manufactured by Fuji Photo Film Co., Ltd.) until the replenishing amount reached two times the tank volume of the color developing solution.

| Processing Step | Temperature (° C.) | Time (sec.) | Replenishing Amount* (ml) |
|---|---|---|---|
| Color development | 38.5 | 45 | 73 |
| Bleach-fixing | 35 | 45 | 60** |
| Rinsing (1) | 35 | 30 | — |
| Rinsing (2) | 35 | 30 | — |
| Rinsing (3) | 35 | 30 | 360 |
| Drying | 80 | 60 | |

*Replenishing amount was per 1 $m^2$ of photographic material

**In addition to 60 ml as shown above, 120 ml was flowed in from Rinsing (1) per 1 $m^2$ of photographic material. (The rinsing was in a 3-tank countercurrent system from Rinsing (3) to Rinsing (1).)

Each processing solution had the following composition.

| | Tank Solution | Replenisher |
|---|---|---|
| Color Developing Solution | | |
| Water | 800 ml | 800 ml |
| Ethylenediaminetetraacetic Acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 5.0 g | 10.0 g |
| Sodium Triisopropylnaphthalene (β) sulfonate | 0.1 g | 0.1 g |
| N-Ethyl-N-(β-methanesulfon-amidoethyl)-3-methyl-4-aminoaniline 3/2 Sulfuric Acid Monohydrate | 5.0 g | 11.5 g |
| Water to make | 1,000 ml | 1,000 ml |
| pH (25° C., adjusted with potassium hydroxide and sulfuric acid) | 10.00 | 10.00 |
| Bleach-fixing Solution | | |
| Water | 600 ml | 150 ml |
| Ammonium Thiosulfate (750 g/liter) | 93 ml | 230 ml |
| Ammonium Sulfite | 40 g | 100 g |
| Ammonium Ethylenediamine-tetraacetato Ferrate (III) | 55 g | 135 g |
| Ethylenediaminetetraacetic Acid | 5 g | 12.5 g |
| Nitric Acid (67%) | 30 g | 65 g |
| Water to make | 1,000 ml | 1,000 ml |
| pH (25° C., adjusted with acetic acid and aqueous ammonia) | 6.2 | 6.0 |
| Rinsing Solution (tank solution and replenisher were the same) | | |
| Sodium Chlorinated Isocyanurate | | 0.02 g |
| Deionized Water (electric conductivity: 5 μs/cm or less) | | 1,000 ml |
| pH | | 6.5 |

Samples 001 to 020 were subjected to processing with the running solutions described above without exposure to light to prepare samples of white background and a red light density of each of the samples was measured. Then, in order to simulate processing with insufficient replenishment, the running processing was further conducted two rounds under the condition of the replenishment amount of 1/3 and allowed to stand for one day. Therefore, Samples 001 to 020 were again subjected to processing with the resulting running solutions without exposure to light and a red light density of each of the white background samples thus-obtained was measured. The difference in the red light density of each sample was determined and referred to as C-stain. The results are shown in Table 3 above.

It can be seen from the results shown in Table 3 that in case of using Cyan Coupler (ExC-1) or (C-2) having a pKa of more than 8.7 for comparison, severe increase in C-stain was not observed. On the other hand, severe increase in C-stain was observed with Cyan Coupler (C-5) or (C-6) having a pKa of not more than 8.7, and the C-stain is remarkably restrained by adding Compound 55 into the second layer and fourth layer. Further, with Cyan Coupler (C-3) or (C-4) having a relatively high pKa C-stain was certainly recognized, but the C-stain was not restrained by adding Compound 55 into the second layer and fourth layer.

From these results it is considered that the C-stain which is effectively restrained by the addition of the compound of formula (I) according to the present invention and the C-stain occurred with Cyan Coupler (C-3) or (C-4) are formed by different mechanisms. The effect of the compound of formula (I) for restraining the C-stain is particularly remarkable in case of using the cyan coupler having a pKa of not more than 8 which forms severe C-stain.

As described above, it is understood that the severe C-stain formed by the cyan coupler having a pKa of not more than 8.7 can be restrained by using the compound of formula (I) according to the present invention.

EXAMPLE 2

A surface of a paper support laminated with polyethylene on both sides was subjected to a corona discharge treatment. On the surface subjected to the corona discharge treatment was provided a gelatin undercoat layer containing sodium dodecylbenzenesulfonate, and photographic constituent layers of the first layer to the seventh layer described below were coated in order thereon in a manner similar to Example 1 to prepare a silver halide color photographic light-sensitive material which was designated Sample 101.

In each layer, the same gelatin hardening agent, preservatives, spectral sensitizing dyes, super color sensitizing compound, mercaptotetrazole tetraazaindene and irradiation preventing dyes as described in Example 1 were employed in the same amount as in Example 1 respectively.

Layer Construction

The composition of each layer is described below. The numeral represents the coating amount ($g/m^2$). The numeral for silver halide emulsion represents the coating amount in terms of silver.

Support

Polyethylene-laminated paper containing a white pigment ($TiO_2$) in an amount of 15 wt % and a bluish dye (ultramarine) in the polyethylene layer on the side of the first layer.

| | |
|---|---|
| First Layer (blue-sensitive emulsion layer) | |
| Silver Chlorobromide Emulsion A described above | 0.26 |
| Gelatin | 1.35 |
| Yellow Coupler (ExY) | 0.62 |
| Color Image Stabilizer (Cpd-1) | 0.04 |
| Color Image Stabilizer (Cpd-2) | 0.02 |
| Color Image Stabilizer (Cpd-3) | 0.09 |
| Color Image Stabilizer (Cpd-5) | 0.01 |
| Color Image Stabilizer (Cpd-16) | 0.04 |
| Solvent (Solv-1) | 0.22 |
| Second Layer (color-mixing preventing layer) | |
| Gelatin | 0.99 |
| Color Mixing Preventing Agent (Cpd-4) | 0.09 |
| Color Image Stabilizer (Cpd-7) | 0.13 |
| Solvent (Solv-1) | 0.06 |
| Solvent (Solv-2) | 0.22 |
| Solvent (Solv-7) | 0.02 |
| Ultraviolet Absorber (UV-B) | 0.070 |
| Third Layer (green-sensitive emulsion layer) | |
| Silver Chlorobromide Emulsin B described above | 0.14 |
| Gelatin | 1.36 |
| Magenta Coupler (ExM) | 0.15 |
| Ultraviolet Absorber (UV-3) | 0.14 |
| Color Image Stabilizer (Cpd-2) | 0.013 |
| Color Image Stabilizer (Cpd-5) | 0.013 |

-continued

| | |
|---|---|
| Color Image Stabilizer (Cpd-7) | 0.09 |
| Color Image Stabilizer (Cpd-8) | 0.02 |
| Solvent (Solv-4) | 0.22 |
| Solvent (Solv-5) | 0.11 |
| Solvent (Solv-3) | 0.20 |
| Fourth Layer (color-mixing preventing layer) | |
| Gelatin | 0.71 |
| Color Mixing Preventing Agent (Cpd-4) | 0.06 |
| Color Image Stabilizer (Cpd-7) | 0.10 |
| Solvent (Solv-1) | 0.04 |
| Solvent (Solv-2) | 0.16 |
| Solvent (Solv-7) | 0.015 |
| Fifth Layer (red-sensitive emulsion layer) | |
| Silver Chlorobromide Emulsion C described above | 0.18 |
| Gelatin | 1.20 |
| Cyan Coupler (ExC-1) | 0.03 |
| Cyan Coupler (ExC-2) | 0.25 |
| Color Image Stabilizer (Cpd-17) | 0.02 |
| Color Image Stabilizer (Cpd-18) | 0.04 |
| Color Image Stabilizer (Cpd-19) | 0.08 |
| Color Image Stabilizer (Cpd-20) | 0.08 |
| Color Image Stabilizer (Cpd-8) | 0.03 |
| Color Image Stabilizer (Cpd-7) | 0.08 |
| Solvent (Solv-9) | 0.01 |
| Solvent (Solv-3) | 0.20 |
| Sixth Layer (ultraviolet absorbing layer) | |
| Gelatin | 0.88 |
| Ultraviolet Absorber (UV-4) | 0.45 |
| Solvent (Solv-10) | 0.25 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surface Active Agent (Cpd-11) | 0.01 |

The compounds used for preparing the composition of each layer described above are shown below.

(ExC-2) Cyan Coupler

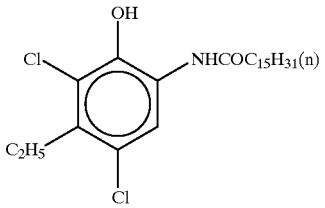

(Cpd-17) Color Image Stabilizer

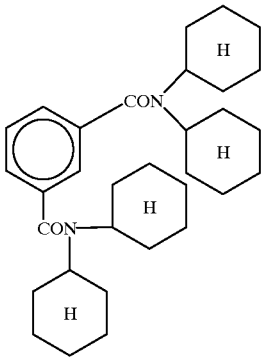

-continued (Cpd-18) Color Image Stabilizer

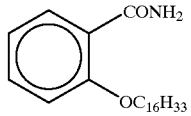

(Cpd-19) Color Image Stabilizer

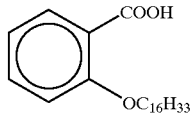

(Cpd-20) Color Image Stabilizer

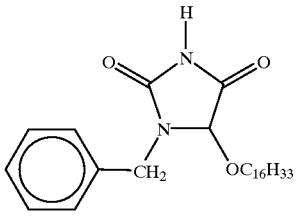

(UV-3) Ultraviolet Absorber

A 4/3/2/2 mixture by weight ratio of (1), (2), (3) and (4)

(1)

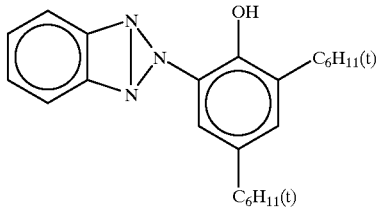

(2)

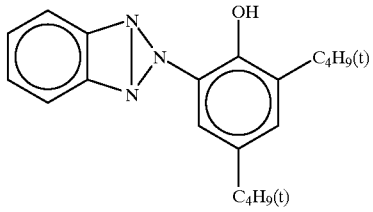

(3)

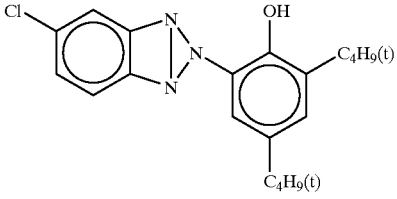

(3)

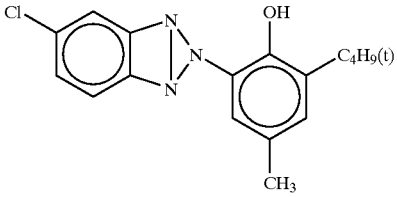

-continued (UV-4) Ultraviolet Absorber

A 6/2/2/2/3 mixture by weight ratio of (1), (2), (3), (4) and ( 5)

(1)

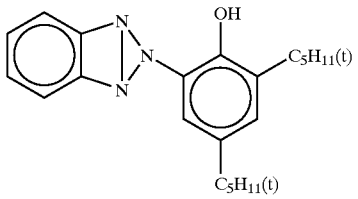

(2)

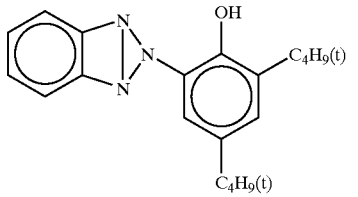

(3)

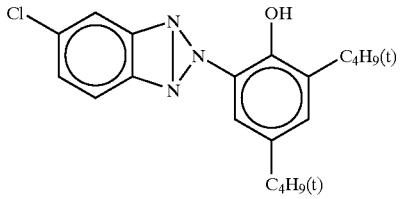

(4)

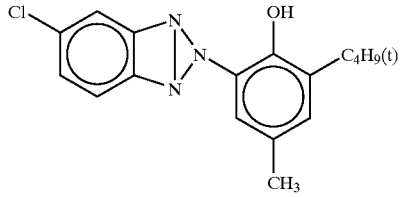

(5)

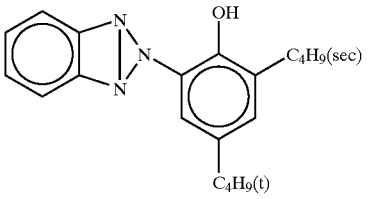

Sample 111 was prepared in the same manner as in Sample 101 except for using 0.13 g/m$^2$ of Cyan Coupler (1) according to the present invention in place of Cyan Coupler (ExC-2) used in Sample 101 and changing the coating amount of the silver halide emulsion to 0.13 g/m$^2$ in terms of silver.

Also, Samples 102 to 105 and 112 to 117 were prepared in the same manner as in Samples 101 and 111 except that the compound represented by formula (I) was added in an amount corresponding to 10% by mole of the amount of Color Mixing Preventing Agent (Cpd-4) used in the second layer and fourth layer as shown in Table 4 below, respectively. Further, Samples 106 to 110 and 118 to 120 were prepared in the same manner as in Sample 111 except for using the equimolar amount of the cyan coupler shown in Table 4 below in place of Cyan Coupler (1).

Running Test A

Sample 101 was cut in a roll of a 127 mm width and subjected to imagewise exposure and continuous processing (running test) according to the following processing steps using a mini lab printer processor (PP1258AR manufactured by Fuji Photo Film Co., Ltd.) until the replenishing amount reached two times the tank volume of the color developing solution. The resulting processing solutions were designated Running Test Solutions A.

| Processing Step | Temperature (° C.) | Time (sec.) | Replenishing Amount* (ml) |
|---|---|---|---|
| Color development | 38.5 | 45 | 45 |
| Bleach-fixing | 38.0 | 45 | 35 |
| Rinsing (1) | 38.0 | 20 | — |
| Rinsing (2) | 38.0 | 20 | — |
| Rinsing (3)** | 38.0 | 20 | — |
| Rinsing (4)** | 38.0 | 30 | 121 |
| Drying | 80 | 60 | |

*Replenishing amount was per 1 m$^2$ of photographic material.

**A rinse cleaning device (RC50D manufactured by Fuji Photo Film Co., Ltd. was installed to Rinsing (3) and a rinsing solutions was taken out and pumped into a reverse osmosis membrane module (RD50D). The transmitted water obtained in the device was supplied to Rinsing (4) and the concentrated solution was returned to Rinsing (3). A pump pressure was so controlled that an amount of water passed through the reverse osmosis membrane module is maintained from 50 to 300 ml/min. Thecirculation system was operated for 10 hours per day at a controlled temperature.

Each processing solution had the following composition.

| | Tank Solution | Replenisher |
|---|---|---|
| Color Developing Solution | | |
| Water | 800 ml | 800 ml |
| Dimethyl Polysiloxane Surface Active Agent (Silicone KF351A, manufactured by Shin-Etsu Chemical Co., Ltd.) | 0.1 g | 0.1 g |
| Triethanolamine | 11.6 g | 11.6 g |
| Ethylenediaminetetraacetic Acid | 4.0 g | 4.0 g |
| Disodium 4,5-dihydroxy-benzene-1,3-disulfonate | 0.5 g | 0.5 g |
| Potassium Chloride | 10.0 g | — |
| Potassium Bromide | 0.040 g | 0.010 g |
| Triazinyl aminostilbene Fluorescent Brightening Agent (Hakkol FWA-SF, manufactured by Showa Chemical Co., Ltd.) | 2.5 g | 5.0 g |
| Sodium Sulfite | 0.1 g | 0.1 g |
| Disodium-N,N-bis(sulfonato-ethyl)hydroxylamine | 8.5 g | 11.1 g |
| N-Ethyl-N-(β-methanesulfon-amidoethyl)-3-methyl-4-amino-aniline 3/2 Sulfuric Acid Monohydrate | 5.0 g | 15.7 g |
| Potassium Carbonate | 26.3 g | 26.3 g |
| Water to make | 1,000 ml | 1,000 ml |
| pH (25° C., adjusted with potassium hydroxide and sulfuric acid) | 10.15 | 12.50 |
| Bleach-fixing Solution | | |
| Water | 800 ml | 800 ml |
| Ammonium Ethylenediamine-tetraacetato Ferrate(III) | 47.0 g | 94.0 g |
| Ethylenediaminetetraacetic Acid | 1.4 g | 2.8 g |
| m-Carboxymethylbenzene-sulfinic Acid | 8.3 g | 16.5 g |
| Nitric Acid (67%) | 16.5 g | 33.0 g |
| Imidazole | 14.6 g | 29.2 g |
| Ammonium Thiosulfate (750 g/liter) | 107.0 ml | 214.0 ml |
| Ammonium Sulfite | 16.0 g | 32.0 g |
| Potassium Metabisulfite | 23.1 g | 46.2 g |